US011358848B2

(12) United States Patent
Baldi

(10) Patent No.: US 11,358,848 B2
(45) Date of Patent: Jun. 14, 2022

(54) MULTI-FUNCTION LEVERING AND PIVOTING DEVICE FOR THE TOTING OF A PERSONAL WATER OR BEVERAGE BOTTLE

(71) Applicant: Michael Owen Baldi, Walpole, MA (US)

(72) Inventor: Michael Owen Baldi, Walpole, MA (US)

( * ) Notice: Subject to any disclaimer, the term of this patent is extended or adjusted under 35 U.S.C. 154(b) by 0 days.

(21) Appl. No.: 16/534,277

(22) Filed: Aug. 7, 2019

(65) Prior Publication Data

US 2021/0179408 A1 Jun. 17, 2021

(51) Int. Cl.

| | |
|---|---|
| ***B67B 7/14*** | (2006.01) |
| ***B67B 7/16*** | (2006.01) |
| ***B67B 7/18*** | (2006.01) |
| ***B67B 7/44*** | (2006.01) |
| ***A45F 5/02*** | (2006.01) |
| *A45F 5/00* | (2006.01) |

(52) U.S. Cl.

CPC ..... *B67B 7/44* (2013.01); *B67B 7/162* (2013.01); *B67B 7/184* (2013.01); *A45F 5/02* (2013.01); *A45F 2005/006* (2013.01); *A45F 2200/0583* (2013.01)

(58) Field of Classification Search

CPC .... B67B 7/44; B67B 7/14; B67B 7/16; B67B 7/18; B25F 1/00; A45F 2003/166; A45F 2005/006

USPC ..... 224/148.1, 148.8, 148.5, 148.7

See application file for complete search history.

(56) References Cited

U.S. PATENT DOCUMENTS

| | | | | |
|---|---|---|---|---|
| 4,509,784 A * | 4/1985 | Vollers | ..... | B67B 7/18 294/99.1 |
| 8,919,623 B1 * | 12/2014 | Bergeron | ..... | A45F 5/021 224/148.4 |
| 10,610,003 B2 * | 4/2020 | Knoll | ..... | B67B 7/16 |

FOREIGN PATENT DOCUMENTS

| | | | | |
|---|---|---|---|---|
| DE | 102006005311 A1 * | 8/2007 | ..... | B67B 7/18 |
| KR | 2020050035379 A1 * | 3/2006 | ..... | B67B 7/44 |

* cited by examiner

*Primary Examiner* — Daniel J Colilla

(57) ABSTRACT

The present device is an improvement in the manner in which individuals are enabled to more swiftly and conveniently attach, detach, store, reposition, carry, tote, and ultimately access the contents of a commercially manufactured personally sized beverage container having a circumferential flange about its neck region, regardless of either the shape or the size of the containers neck. Being easily affixed and subsequently detached from clothing or accoutrements, this simple and inexpensive device enables the mobile user to enjoy an unencumbered hands-free toting experience which in turn further promotes responsible behavior in such activities as the disposal, the recycling, or reuse of the container. Further, the frame itself is configured to be potentially cast from either a recycled resin-based material, or it can also be just as efficiently cast, or die-cut from a non-floatable type of recyclable metal, which makes the end-use of this convenience device most environmentally friendly.

3 Claims, 18 Drawing Sheets

MULTI-FUNCTION LEVERING AND PIVOTING DEVICE FOR THE TOTING OF A PERSONAL WATER OR BEVERAGE BOTTLE

FIELD OF THE INVENTION

The present device is an improvement in the manner in which individuals are enabled to more swiftly and conveniently attach, detach, store, reposition, carry, tote, and ultimately access the contents of a commercially made personally sized water or beverage bottle, regardless of either the shape or size of the bottles neck.

BACKGROUND AND SUMMARY OF THE INVENTION

There are currently many forms of so-called 'hands-free' devices which provide the means for an individual to tote a commercially made water or beverage bottle, of a personal size, utilizing the neck of a bottle as a means by which the bottle is retained by the device. However those types of devices of the current art, which are solely of a rigid design, and which most commonly use a single set of fixed width prongs to retain a bottle about the neck, have several shortcomings since this type of a device;

1) most frequently only affixes to belts worn about the waist;

2) are typically made to accommodate just one tier of bottle neck size only, and are therefore not universal in application, since the shapes and/or the neck sizes of commercially produced personal water or beverage bottles tend to vary substantially between manufacturers;

3) nor can this type of a device be field modified, and such devices of this type;

4) are less apt to remain in place as the users body position changes when the user is engaged in highly active situations.

5) Nor do devices of this type, having prongs of a rigidly-fixed design, possess the absolute ability to keep a bottle secured within the grip of the device should the bottom of the bottle be subjected to an upward thrusting force, which tends to dislodge the device from a belt, and/or may otherwise tend to dislodge the bottle from the device itself. A particular shortcoming which is further exacerbated because of;

6) the slight dimensional variations that exist among the vast array of commercially manufactured bottle necks, whose diameters and/or proprietary shapes, which may vary slightly or substantially between bottle manufacturers, prevents the rigidly-fixed prongs of the aforementioned device to readily accept, and/or to otherwise readily adapt to these wide-ranging variable characteristics, since the rigidly designed devices of the current art are not destined to grip the necks of all types of bottles with an equal and assured firmness, even among those several tiers of commercially manufactured bottles that fall within the most common neck size groups.

The present device however, being both gravitationally sensitive, due to its inherent pivoting capabilities, and the continual retention forces its structure and components collectively impose on and around the neck of a bottle, coupled with the ability for the retaining characteristics of the present device to be customized to receive and retain virtually any personally sized water or beverage bottle, remedies all of the aforementioned shortcomings. Most particularly for those tiers of bottles which consist of the several most common neck size groups, that being bottles of both the diametrically narrow neck and diametrically wide neck variety, as each featured component of the present device is designed to complement the other as the;

1) environ, 2) the intermittent hydration needs and 3) the beverage preferences of the consuming public most assuredly change.

By combining the hands-free toting capabilities with an array of selective restraining features, the present device provides practical functionality while at the same time assuring swift access to the contents of a personally sized water or beverage bottle, characteristics which would be of special interest to those individuals who are engaged in active occupations, or physically challenging activities, such as construction workers, house painters, bucket truck operators, warehouse workers, roofers, landscapers, charity walkers, police officers, military personnel, active homeowners, homemakers, field hands, festival attendees, and tourists to name but a few examples of the greater hydrating population who would welcome the many conveniences this present device has to offer. Further, due to the universal characteristics inherent in the device it may also be used to tote various cleaning fluid bottles, or the like, which provides the device with an even greater end use appeal.

And in those cases where other currently available toting devices incorporate a single elastic connector, such as a common o-ring, or an elastic connector with an appendage, or a elastic die cut fabric in their designs, each of which may be respectively fitted about the neck of a bottle, but then revert to using a mechanical type of closure clip to affix the elastic connector, such as the common o-ring to the bottle, and subsequently the mechanical clip bearing the duly restrained bottle to an accoutrement are, by their very nature, inconvenient devices since a mechanical clip;

1) fails to afford the user swift and unencumbered access to the contents of the bottle because;

2) the mechanical closures employed by these devices need to be manually and awkwardly manipulated, most particularly with both hands, in order to successfully free a bottle from the accoutrement to which it has been attached, which is a typically a frequent occurrence. Nor do these current toting devices, which utilize a mechanical closure clip;

3) afford the user the ability to swiftly and conveniently reattach, or to reposition the bottle in any number of ways, thereby denying the user the ability to quickly and selectively change a bottles preferred location whenever adjustments become necessary as the users activities change throughout the day, or as the conditions of the users environment may mandate, such as might happen when less sanitary environs are encountered, as might be the case when accessing certain public restrooms as an example, whereas the present device can be swiftly moved to other selected parts of accoutrements or courtesy protuberances in a variety of different ways.

In addition, a single size elastic connector, or a single size elastic connector with an appendage, or a single size die cut elastic fabric, are by their very nature;

1) difficult and/or 2) awkward to install and/or 3) are subsequently difficult to remove as well due to the inherent narrowness of the circumferential opening of the single sized elastic connector coupled with the high tensile strength the elastic connector is required to have in order to successfully support and restrain the weighty contents of a bottle under all the types of dynamic service conditions. In addition, because a single size elastic connector, such as common o-ring, limits the user to just one common group of bottles, that being of either of the narrow neck or of the wide neck variety, this shortcoming therefore renders this class of a device;

5) not universally functional, since the single sized opening of the connector can only be used to typically secure the class of commercially available bottle of either the narrow neck, or the wide neck variety, but not both with the same elastic component. Whereas the present device, as one of its featured characteristics, resolves both of these issues by providing the means whereby an adjustable elastic connector, or otherwise a single sized elastic connector, such as a common o-ring, may be used to secure and restrain either a bottle of the diametrically narrow neck, or the diametrically wide neck variety, in addition to also providing the means whereby the present device, being provided with an adjustable connector, can accept, restrain, and ultimately support a personally sized bottle having a neck of any uncommon shape or size, with equal swiftness, and with equal integrity of purpose.

In addition, should the user of the device prefer to utilize clamping prongs in lieu of utilizing a elastic connector to secure the neck of a bottle to the frame, the present device may also be easily outfitted with a variety of customized external clamp configurations, and/or adaptors, that allow the featured frame of the present device to receive, retain, and support any number of novelty bottle neck types, since the pivoting and dimensional aspects relative to an internal connector of a supplemental adaptor comprised of a set of customized clamping prongs, if optionally selected and duly configured, may remain unchanged to accommodate this preference.

The present device is also configured to provide those with impaired hand or finger strength with a levering means;

1) by which small plastic twist-off bottle caps may be more easily removed, since this is the most common consumer complaint as reported by those commercial bottle manufacturers who have taken the initiative to reduce waste by producing caps of a smaller size;

2) and by which firmly fixed twist-off metal caps, and pry off metal caps, and even the flip-top tabs and their associated can lids, may also be more easily removed from a container by those with impaired hand or finger strength.

Further; tens of thousands of commercially produced water and beverage bottles are improperly discarded, or are otherwise randomly abandoned in the United States along hiking trails, roadways, and waterways every day, without regard for the environmental or scenic impact these millions of stray bottles are annually and collectively having on the terrestrial eco-systems, waterways, fish, wildlife, and the oceans of the world. The reason for this behavior is primarily due to the inconvenience of toting a disposable bottle once it has been either emptied, or partially emptied of its contents. However, by providing a small lightweight hands-free toting device of universal application, a commercially manufactured water or beverage container of a personal size, once emptied or partially emptied of its contents, may now be easily and conveniently toted, without bother, to a proper disposal system, or which may otherwise be simply and naturally transformed into a refillable container, and therefore, especially where trending publicly accessible hydration replenishment programs exist, it may no longer be a sensible act to dispose of an empty container merely after a single use, since a personally sized bottle can now be conveniently toted and subsequently refilled in any number of more socially responsible ways. Therefore the combination of convenience features and characteristics of the present device has the potential for addressing pressing environmental concerns as well.

Therefore, by providing a hands-free device of this caliber, the consumer is provided with the means and methods which ultimately promotes responsible reuse, recycling, and overall proper disposal behavior, since toting an empty, or compromised container is no longer either an impractical, nor a burdensome endeavor, but rather the toting becomes a completely responsible and much more cost effective and convenient activity to engage in.

Thus the present multi-functional hands-free device allows for any type of personal water or beverage bottle, of any neck size, and of any shape, to be swiftly and easily toted, accessed, mounted, removed, stored, carried, slung, attached, detached, repositioned, replaced, recycled, refilled, or otherwise swiftly rendered neutral for either desk top or table-top use, with each cited action being quickly and more easily performed by dexterous or impaired hands alike, in the customized deployment, and selective end-use, of this cup holder friendly, personal water, or beverage bottle, toting device.

Further depicted is an auxiliary closure stop which may be fitted to the channeled levering frame, and subsequently pivoted to close off a divergent channel for the purpose of disallowing an accoutrement, such as pocketbook strap, from exiting the divergent channel subsequent to the accoutrement having been guided into the extension aperture.

Figure 25:
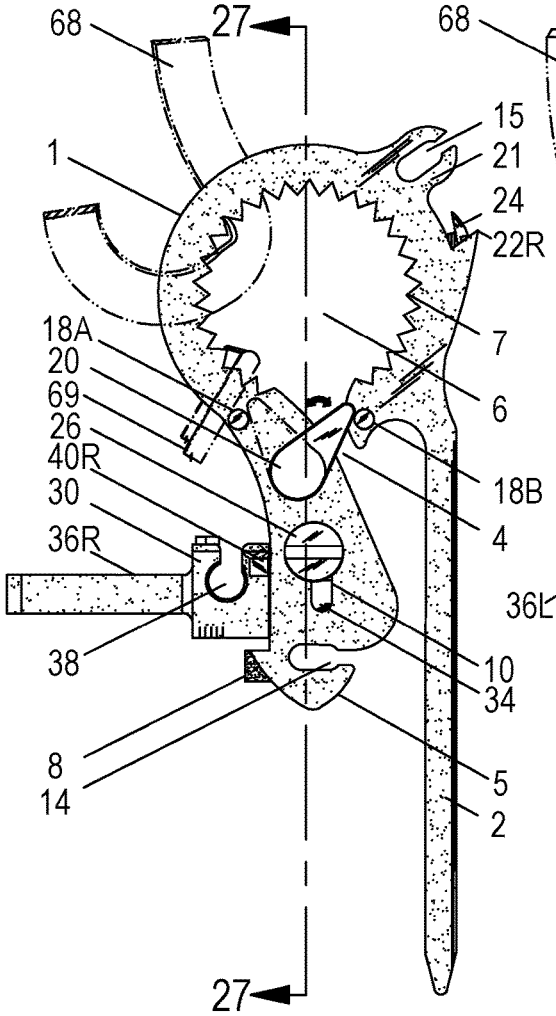
FIG. 25 A side view depicting one possible configuration of the present device depicting the manner in which a supplemental adaptor, in lieu of an adjustable elastic connector, may be alternatively affixed to a channeled levering frame utilizing an ancillary key, and an associated thumbscrew, which serve in combination to interact with the notch of a supplemental adaptor connector, thereby allowing a channeled levering frame to pivot about the axial feature of the duly retained supplemental adaptor connector.
Figure 26:
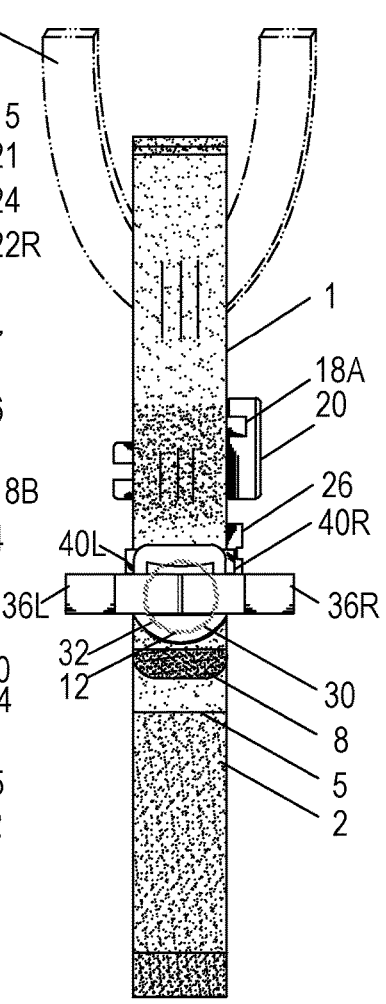

FIG. 26 A front view of the present assembled device relative to FIG. 25.

Figure 27:
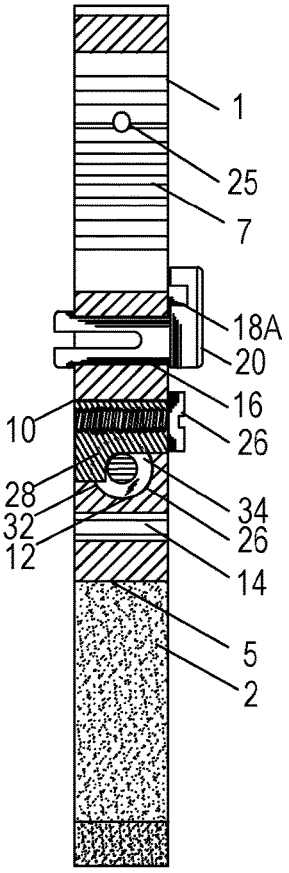

FIG. 27 A sectional front view of the present assembled device relative to FIG. 25 and FIG. 26, depicting the internal manner in which an ancillary key, secured to a channeled levering frame by an associated thumbscrew, or a horseshoe clip not shown, interacts with the notch of a supplemental adaptor connector, thereby allowing a duly configured channeled levering frame to be pivoted to and fro, from a vertical alignment to a horizontal position, for respectively toting and subsequently accessing the contents of a bottle.

Figure 28:
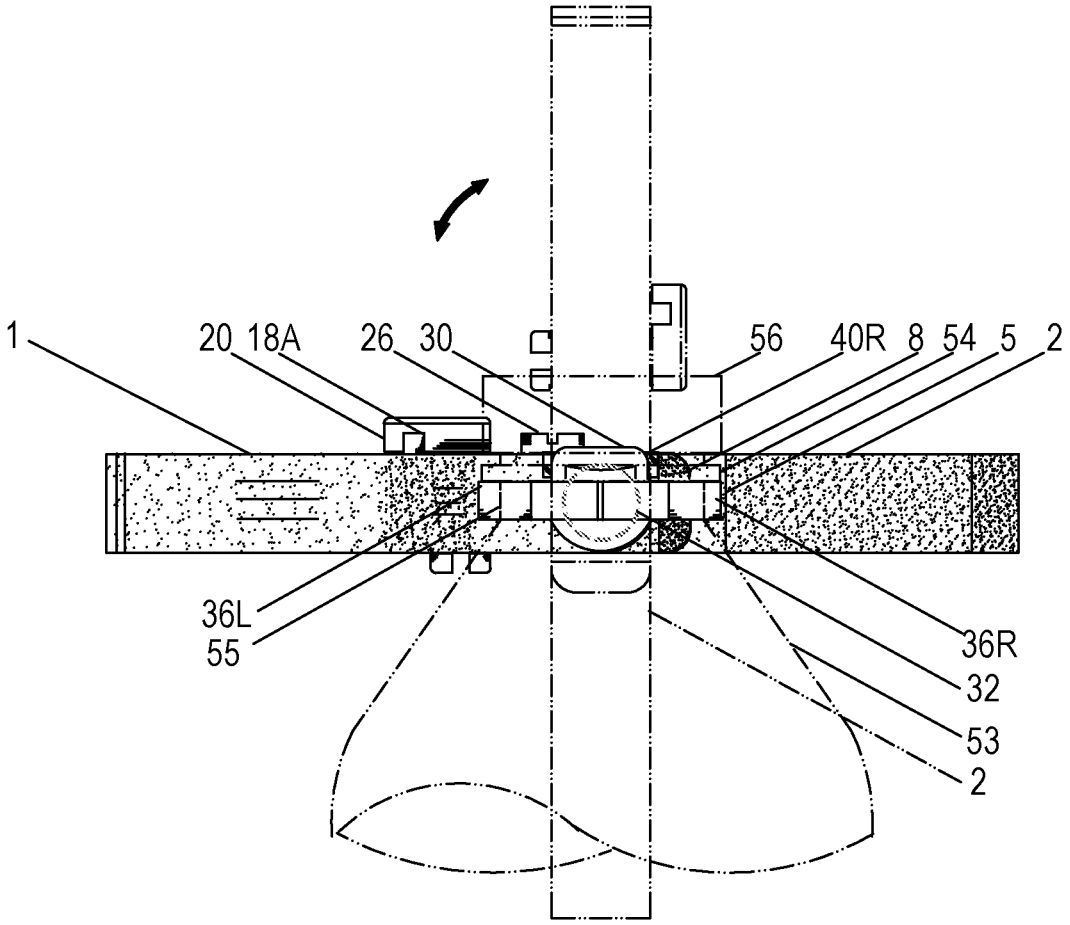

FIG. 28 A front view of the present device relative to FIG. 26 depicting a channeled levering frame pivoted to a full horizontal position about the axis of the supplemental adaptor connector, thereby allowing the user lip access to the contents of a bottle.

Figure 29:
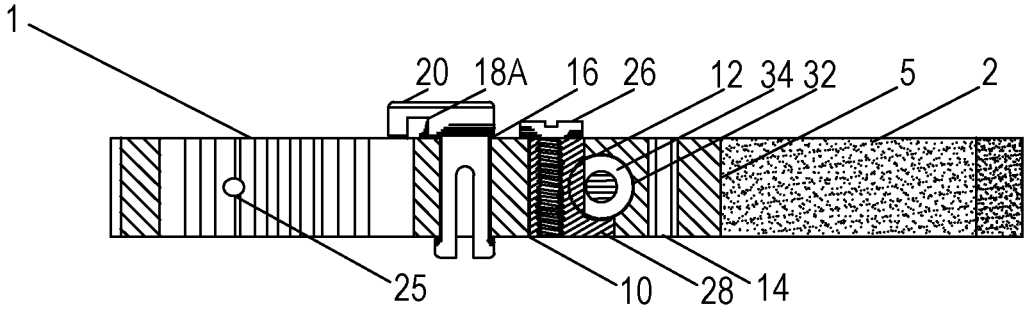

FIG. 29 A sectional front view of the present device relative to FIG. 28 depicting the internal manner in which an ancillary key, fitted into a transverse keyhole aperture and thereafter secured to the channeled levering frame by an associated thumbscrew, interacts with the notch of the supplemental adaptor connector, thereby allowing the channeled levering frame to be pivoted to and fro, to attain either a vertical or a horizontal position relative to the top to bottom axis of a bottle.

Figure 30:
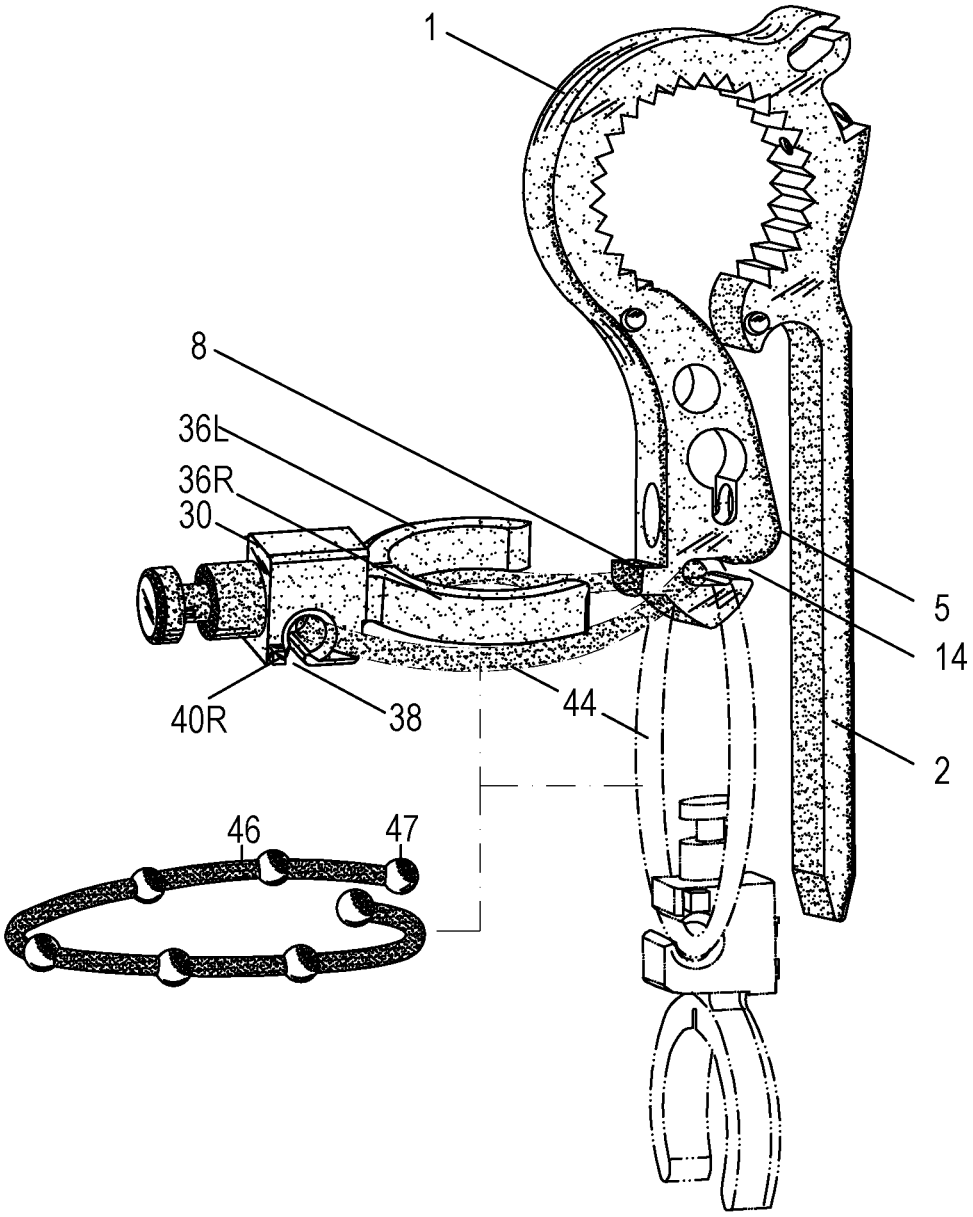

FIG. 30 A perspective view of the present device depicting a channeled levering frame in vertical alignment as the assembled device, of this particular configuration, would appear when a supplemental adaptor, removed from a channeled levering frame, is paired with a elastic connector, thereby alternatively utilizing the transitioned supplemental adaptor as an anchoring means which further enables a user of dexterous or impaired finger abilities alike, to more easily lever a elastic connector onto and off of the neck of a bottle.

Figure 31:
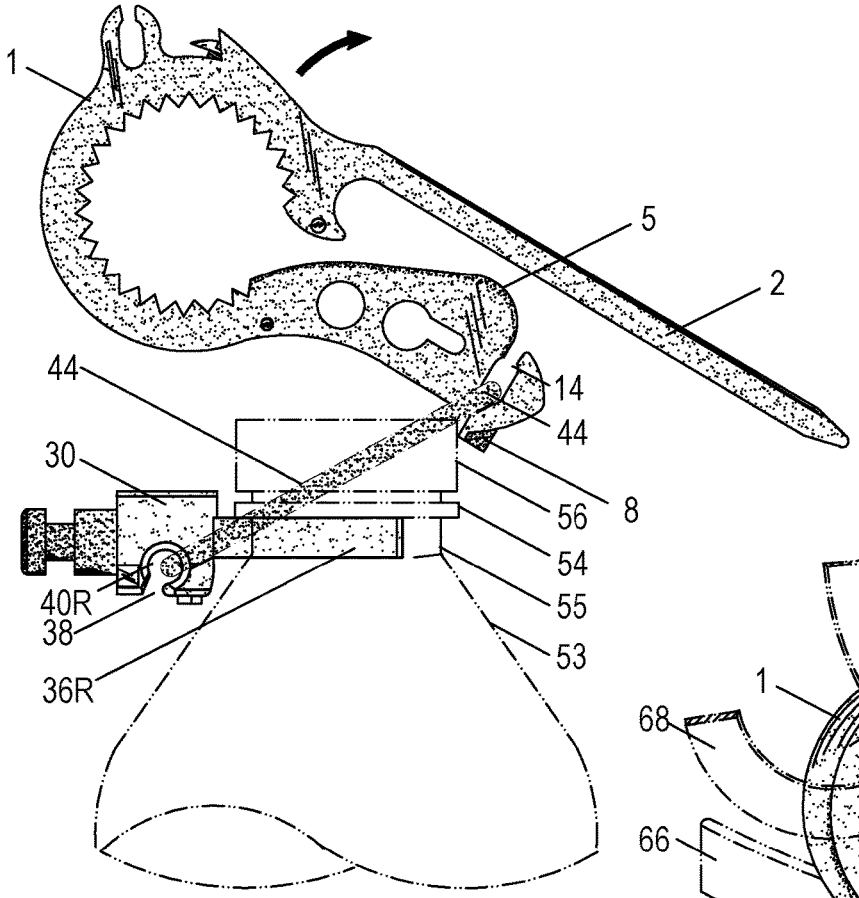

FIG. 31 A side view of a channeled levering frame and a supplemental adaptor, relative to FIG. 30, as the assembly may appear when in the midst of utilizing a support/levering protuberance, in unison with the anchoring action of a supplemental adaptor, which has been previously affixed to the neck of a bottle, to produce a configuration that subsequently allows an elastic connector, such as a suitably sized o-ring, to be levered onto, or off of, the neck of a commercially manufactured bottle.

Figure 32:
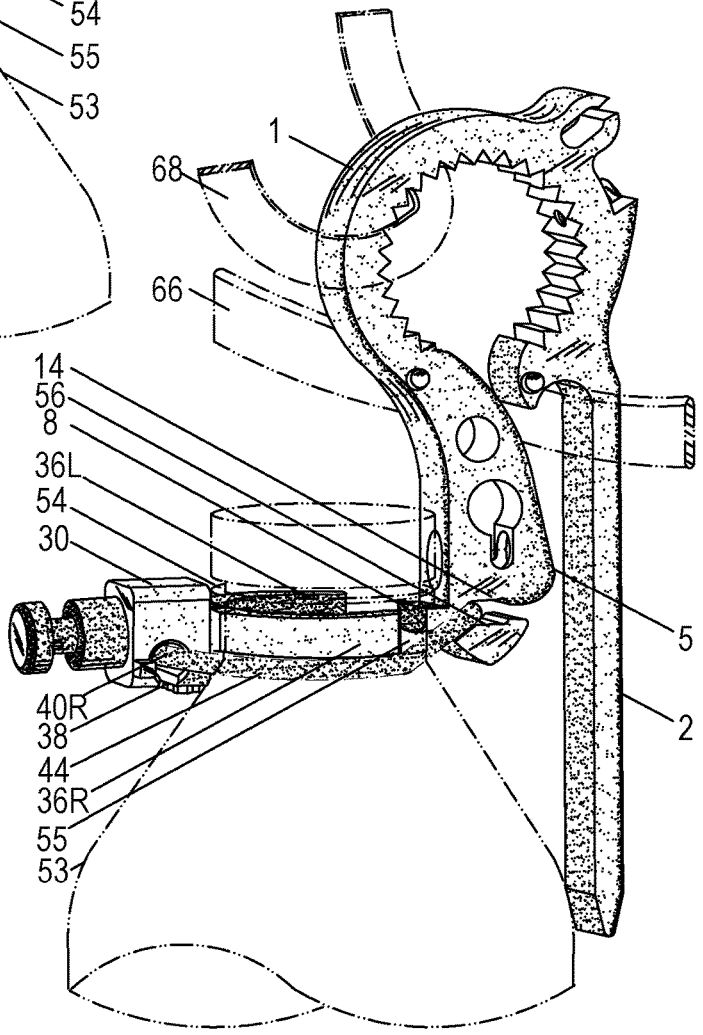

FIG. 32 A perspective view of the present device, relative to FIG. 31, depicting a channeled levering frame now in vertical alignment, as the assembled device, of this particular configuration, may appear while retaining and supporting a commercially manufactured bottle when attached to various accoutrements, such as being suspended on a belt worn about the waist, or suspended from the strap of a pocketbook for instance.

Figure 33:
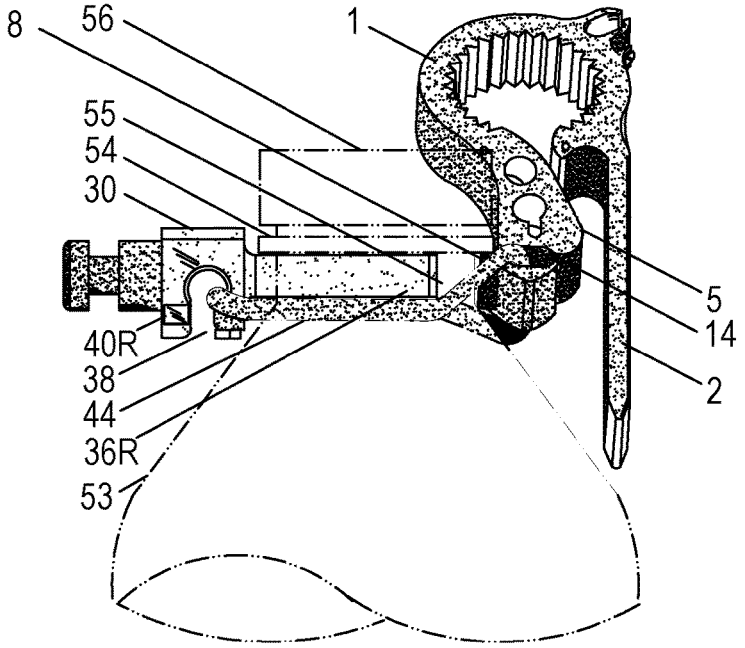

FIG. 33 A perspective side view of the present device, relative to FIG. 32, depicting a channeled levering frame while in the midst of being pivoted upon the axis of a support/levering protuberance, which is being held more firmly beneath the circumferential flange of a commercially manufactured bottle by the increased tensile force being imposed upon the entire assembly by an elastic connector, such as a common o-ring, which is now in torsion, thereby allowing the user lip access to the contents of a bottle.

Figure 34:
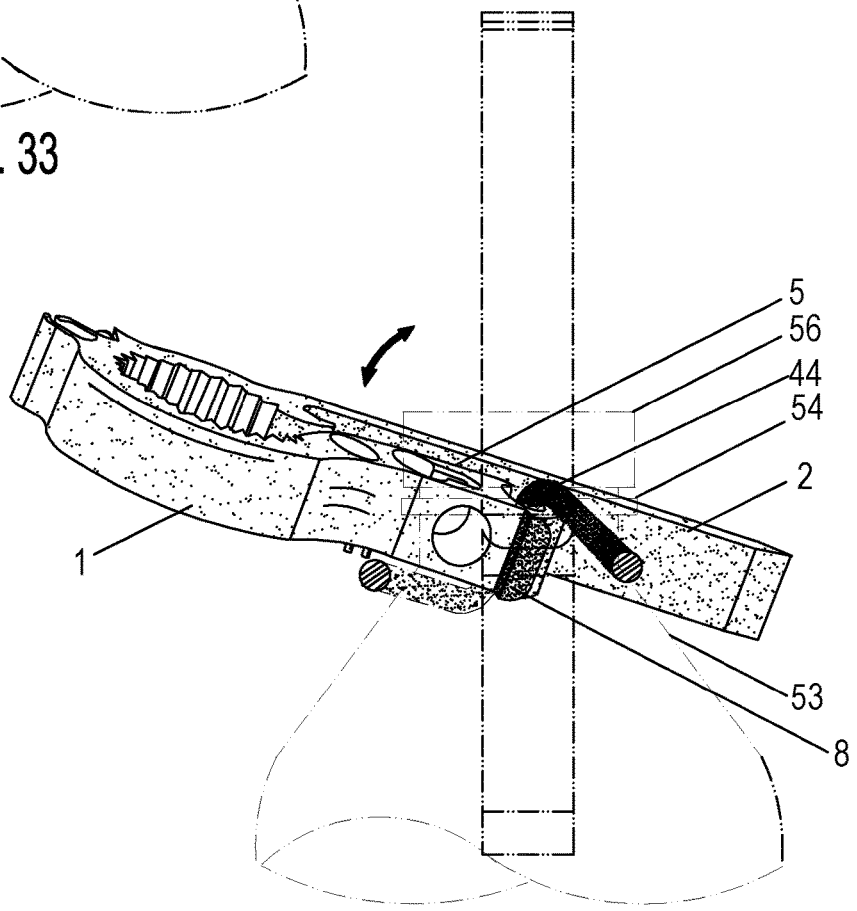

FIG. 34 A perspective frontal view of the present device, relative to FIG. 33, depicting a partial cut-away view of an elastic connector in torsion when a channeled levering frame is being pivoted upon a support/levering protuberance which is being held more firmly beneath the circumferential flange of a commercially manufactured bottle by the increased tensile force being imposed upon the entire assembly by the elastic connector, thereby allowing the user lip access to the contents of a bottle.

Figure 35:
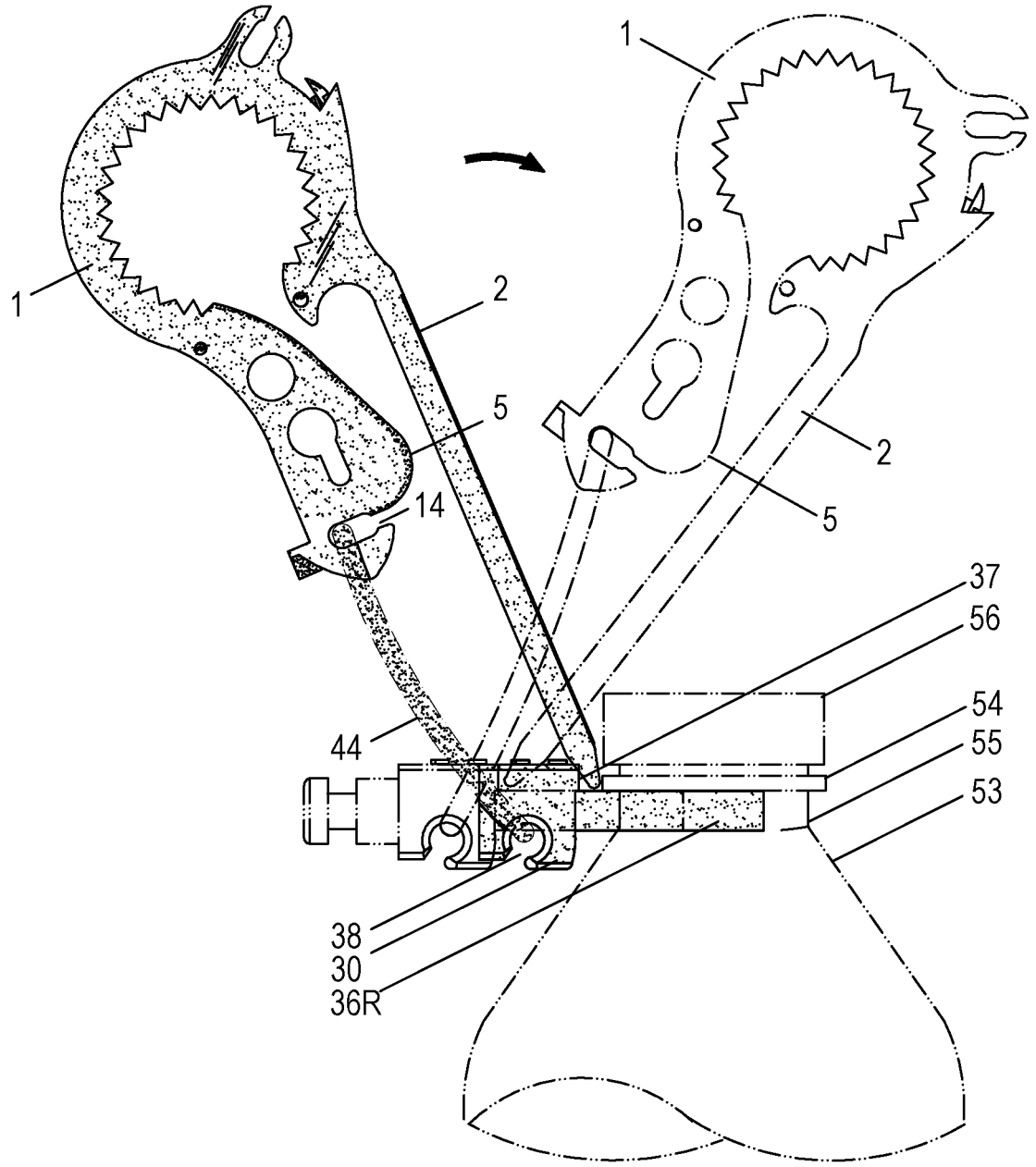

FIG. 35 A side view of the present device, relative to FIG. 32, demonstrating the sequential manner in which a supplemental adaptor, previously clamped onto the neck of a bottle, may be subsequently levered off, and thereby removed, by utilizing a portion of a channeled levering frame as a prying tool as it would appear when acting against a raised edge of a supplemental adaptor.

Figure 36:
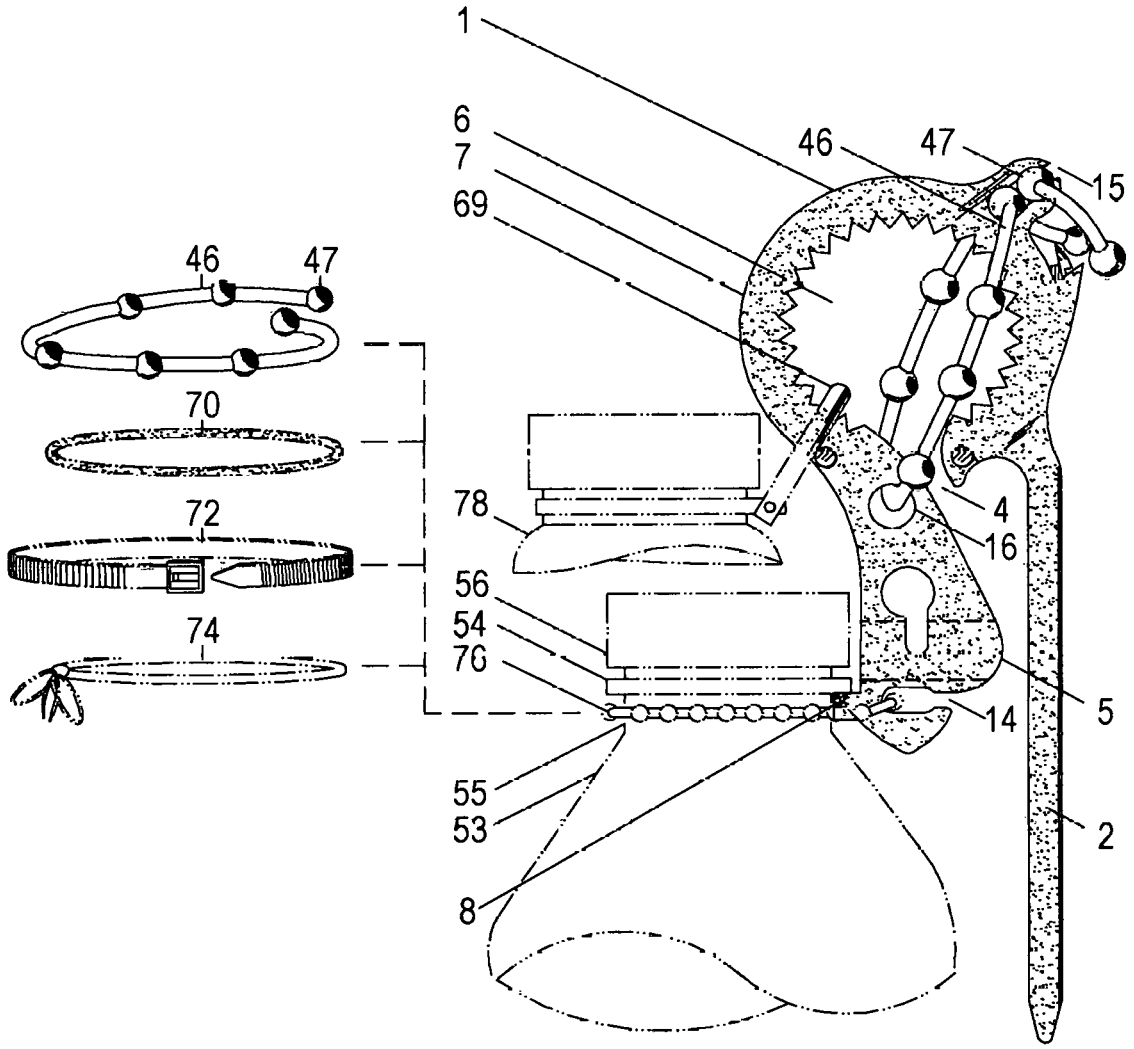

FIG. 36 A side view of one particular configuration of the present device depicting the manner in which various elastic connectors, such as an adjustable elastic connector comprised of integrated restraining stops, or a variety of elastic connectors of the continuous type, such as common o-rings, or a variety of non-continuous types of elastic and/or pliant connectors such as laces, cable ties, or the like, may be integrated and utilized with a channeled levering frame to retain and/or to support a commercially manufactured bottle about the neck, or to otherwise serve as an ancillary retaining means for fastening extraneous items to the channeled levering frame, or which may be further utilized, in lieu of the aforementioned pivoting closure stop, as a means by which an accoutrement and/or an extraneous device, such as the clip of a refillable beverage container, may be disallowed from exiting the extension aperture via the divergent channel through which the extraneous item had been previously passed.

REFERENCE NUMERALS

1 channeled levering frame
2 elongated levering arm
3 blind terminus channel
4 divergent channel
5 clenching arm
6 extension aperture
7 serrated grip ring
8 support/levering protuberance
10 transverse keyhole aperture
12 aperture to receive a supplemental adaptor connector
14 retention aperture for storing/securing/restraining a sinuous connector
15 retention aperture for storing/securing/restraining a sinuous connector
16 ancillary transverse aperture
18A limiting stop
18B limiting stop
20 closure stop
21 jacking arm
22L ancillary jacking lip
22R ancillary jacking lip
24 ancillary jacking protuberance
25 ancillary jacking protuberance receiver port
26 thumbscrew
28 ancillary key
30 supplemental adaptor
32 supplemental adaptor connector
34 retaining notch of a supplemental adaptor connector
36L left retention/clamping prong
36R right retention/clamping prong
37 raised edge integral to a supplemental adaptor
38 ancillary aperture to an supplemental adaptor
40L integrated stop to limit the amount a channeled levering frame may rotate
40R integrated stop to limit the amount a channeled levering frame may rotate
41 typical representative elastic connector
42 elastic o-ring type connector of a lesser diameter
44 elastic o-ring type connector of a larger diameter
46 adjustable sinuous connector comprised of integrated restraining stops
47 integrated restraining stop integral to an adjustable sinuous connector
48 tensioned narrow portion of a sinuous connector comprised of integrated restraining stops
50 commercially manufactured bottle of the narrow neck variety
52 commercially manufactured bottle of the wide neck variety
53 commercially manufactured bottle of a generic variety
54 circumferential flange found on the neck of a commercially manufactured bottle in the region of the neck
55 bottle neck
56 bottle cap of the screw-on variety
58 bottle cap of the twist-off variety
60 bottle cap of the press-on variety
61 glass bottle able to receive a press-on cap
62 container of the flip-top variety
64 flip-top tab
65 lid of a flip-top can
66 belt worn about the waist as an example of an accoutrement
68 strap of a pocketbook as an example of an accoutrement
69 attachment clip typically found affixed to the neck of a commercially manufactured refillable beverage container

70 common elastic o-ring type connector consisting of a variety of sizes and fitments
72 common cable tie
74 generic lacing
76 common beaded cable tie
78 refillable beverage container

DETAILED DESCRIPTION OF THE INVENTION

Figure 1:
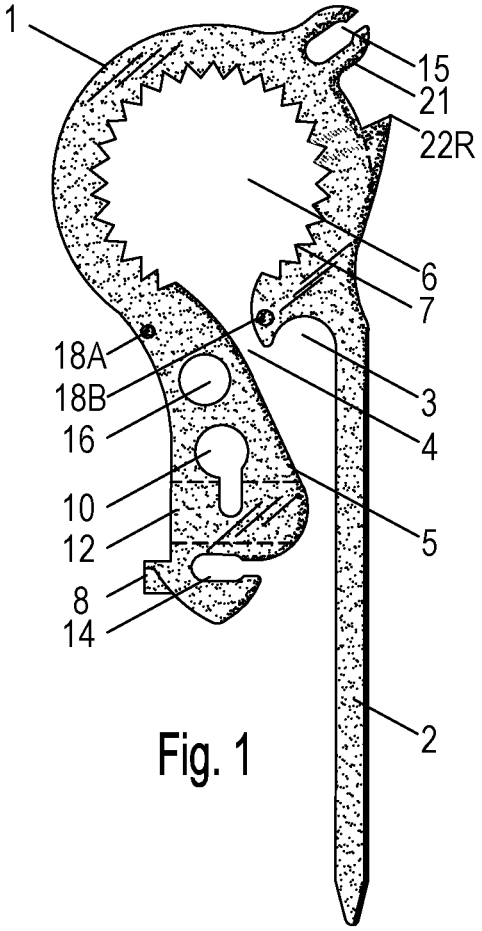
FIG. 1 A side view depicting the integral features of a channeled levering frame.

FIG. 1 A side view of a channeled levering frame 1 depicting a clenching arm 5, and an opposing elongated levering arm 2, each of which respectively forms one side of a self-aligning blind terminus channel 3 which allows for an accoutrement to slide into the interior of said frame 1, such that said accoutrement may be alternatively redirected into a divergent channel 4 to be subsequently retained within the extension aperture 6 whose inner circumferential wall may also be provided with a serrated grip ring 7 which allows, along with the resilience provided to the frame 1 by the combined attributes of the divergent channel 4, and the elongated levering arm 2, to serve as a clamping means by which the cap on a personally sized water or beverage bottle may be removed in a manner as hereinafter described.

Figure 2:
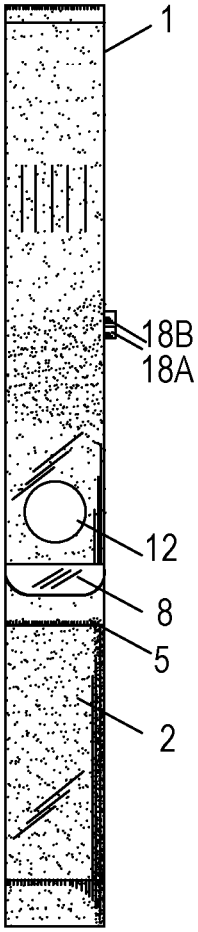
FIG. 2 A front view of a channeled levering frame relative to FIG. 1.

FIG. 2 A front view of the channeled levering frame 1 relative to FIG. 1.

Figure 3:
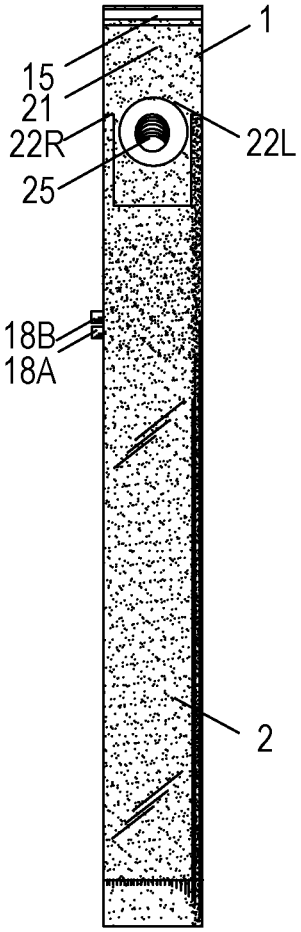
FIG. 3 A rear view of a channeled levering frame relative to FIG. 1.

FIG. 3 A rear view of the channeled levering frame 1, relative to FIG. 1, depicting ancillary jacking protuberances 22L, 22R, and an ancillary jacking protuberance receiver port 25 into which an ancillary jacking protuberance may be subsequently inserted, and thereby utilized, in combination with the elongated levering arm 2, to upwardly lever a pressed on type of bottle cap, typically of the metal variety, from off of the top of a bottle, in a manner as hereinafter described.

Figure 4:
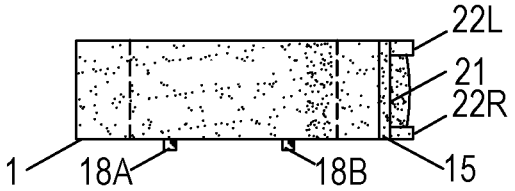
FIG. 4 A top view of a channeled levering frame relative to FIG. 1.

FIG. 4 A top view of the channeled levering frame 1 relative to FIG. 1.

Figure 5:
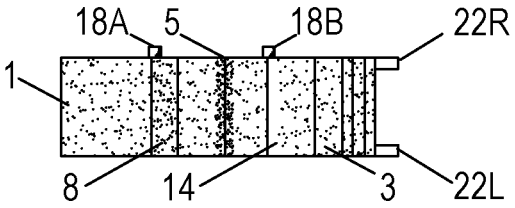
FIG. 5 A bottom view of a channeled levering frame relative to FIG. 1.

FIG. 5 A bottom view of the channeled levering frame 1 relative to FIG. 1.

Figure 6:
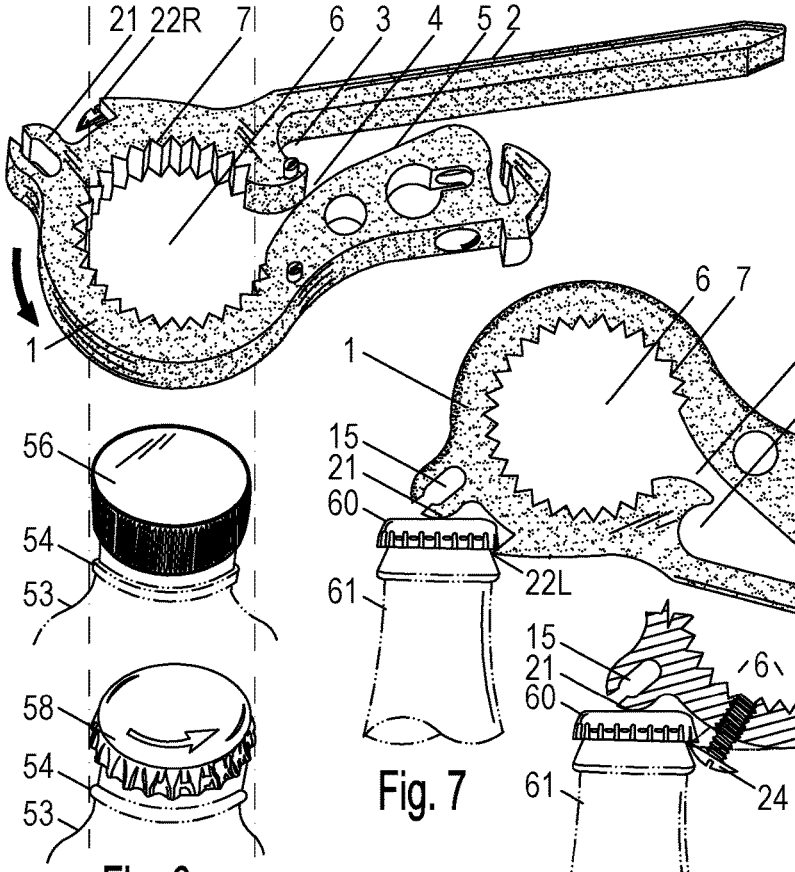
FIG. 6 A perspective view depicting the manner in which a centrally situated divergent channel allows a channeled levering frame to be expanded and subsequently fitted to a twist off type of bottle cap, such that the ensuing clamping action, in combination with the gripping action of the serrated ring, may be utilized to rotationally lever various forms of twist-off bottle caps from off of the top of a commercially manufactured bottle.

FIG. 6 A perspective view depicting the manner in which a divergent channel 4 affords an elongated levering arm 2 to be outwardly expanded such that the diameter of the extension aperture 6 may be thereby increased to allow the extension aperture 6 of the channeled levering frame 1 to be subsequently fitted over and onto a bottle cap of the screw-on variety 56, or onto a bottle cap of the twist-off variety 58, such that the resulting clamping action, in combination with the gripping characteristics of the serrated grip ring 7, are thereby utilized in unison to rotationally lever various forms of screw-on 56, or twist-off 58 bottle caps, from off of the top of a commercially manufactured bottle 53.

Figure 7:
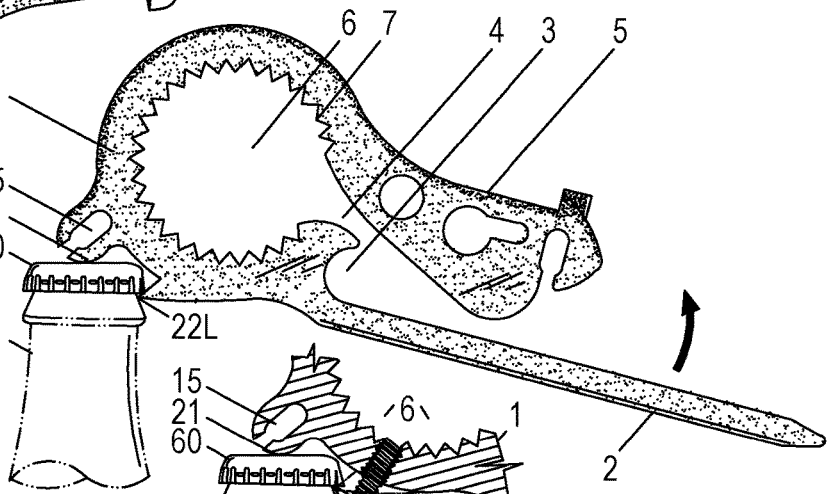
FIG. 7 A side view of the channeled levering frame depicting the manner in which an ancillary jacking lip, integral to a channeled levering frame, may be used to upwardly lever a press-on type of bottle cap from off of the top of a commercially manufactured bottle.

FIG. 7 A side view perspective depicting the manner in which an ancillary jacking lip 22L,22R integral to a channeled levering frame 1, acting in unison with the opposing jacking arm 21 and the elongated levering arm 2, may be used to upwardly lever a press-on type of bottle cap 60, typically of the metal variety, from off of the top of a commercially manufactured bottle 61.

Figure 8:
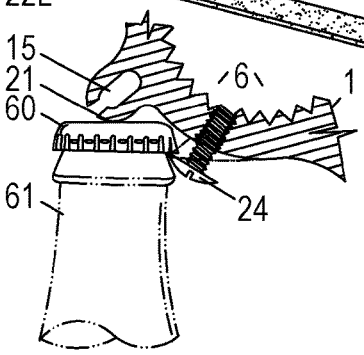
FIG. 8 A cross sectional perspective, relative to FIG. 8, depicting the manner in which an ancillary jacking protuberance, incorporated into a channeled levering frame, may be used to upwardly lever a press-on type of bottle cap from off of the top of a commercially manufactured bottle.

FIG. 8 A cross sectional perspective, in the spirit of FIG. 7, depicting the manner in which an ancillary jacking protuberance 24, affixed to a channeled levering frame 1, acting in unison with a jacking arm 21 and the elongated levering arm 2, may be used to upwardly lever a press-on type of bottle cap 60, typically of the metal variety, from off of the top of a commercially manufactured glass bottle 61.

Figure 9:
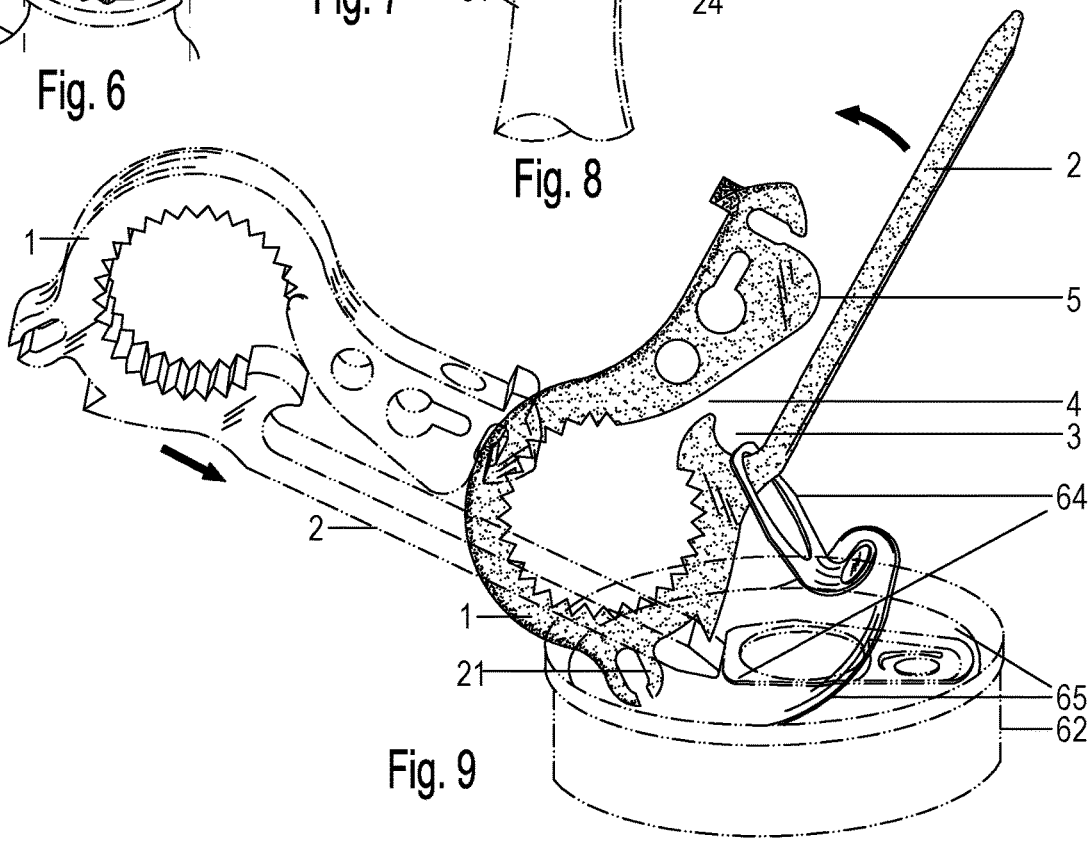
FIG. 9 A perspective view depicting the sequential manner in which a channeled levering frame may be utilized to lance and lift a flip-top tab, and to subsequently lever the associated lid from off of a commercially manufactured container of the flip-top variety.

FIG. 9 A perspective view depicting the sequential manner in which a self-aligning blind terminus channel 3 of a channeled levering frame 1 produces a means whereby the ring of a flip-top tab 64 may be initially lanced and, by subsequently utilizing an applied force exerted by and through the elongated levering arm 2, serves to lever the flip-top tab 64, and an associated pull-off lid 65 when applicable, from off of a commercially manufactured container of the flip-top variety 62.

Figure 10:
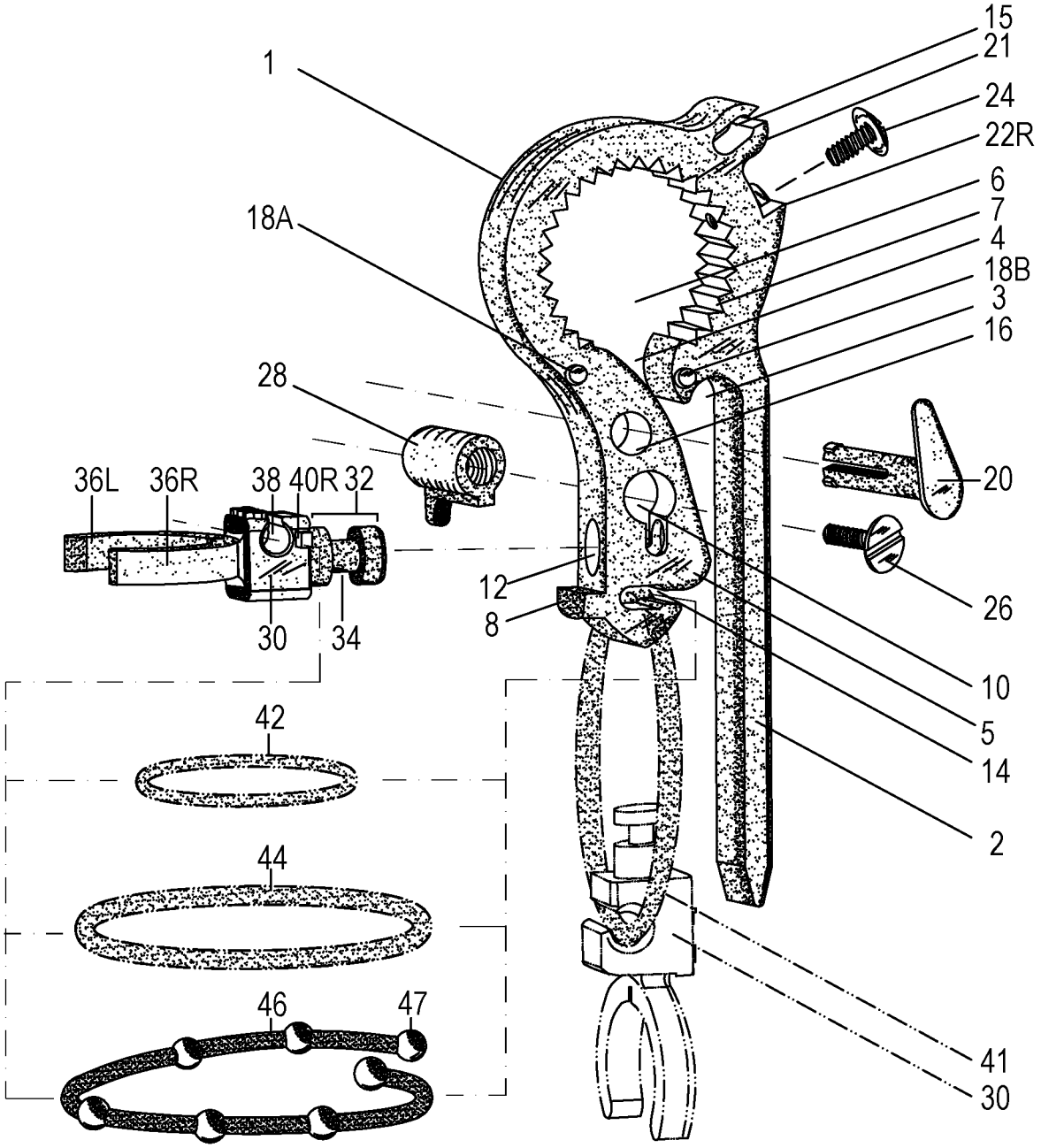
FIG. 10 An exploded perspective view of the present device depicting the manner in which the various ancillary components may be optionally assembled, affixed to, and/or utilized in the deployment of the present device.

FIG. 10 An exploded perspective view of the present device depicting the manner in which the various numerically referenced components, and their respective numerically referenced features and characteristics, may be optionally mixed, matched, assembled, and/or may otherwise interact either independently, or in combination with one another.

More specifically depicted is;

a) A self-aligning blind terminus channel 3 of a channeled levering frame 1 which serves, in unison with the clenching arm 5, to receive various accoutrements upon which the present device may be secured to, hung from, and/or suspended upon, with the elongated levering arm 2 additionally providing the means by which a levering process may be further enhanced.

b) A divergent channel 4 which is connected to the self-aligning blind terminus channel 3 of the channeled levering frame 1, and which egresses into an extension aperture 6 which enhances the levering capabilities of the present device while providing to the present device the added ability to receive, be hung from, and/or suspended upon various forms of accoutrements and/or protuberances, and to further allow the channeled levering frame 1 to be openly expanded, and subsequently brought to bear on the outer walls of an aforementioned bottle cap 56,58 of FIG. 6, such that a bottle cap may be rotationally removed from a bottle 53 via the ensuing internal and externally applied clamping forces being exerted upon the aforesaid bottle cap 56,58 by the combined and collective gripping, levering and rotational attributes of the channeled levering frame 1, and wherein the levering/clamping and rotational process may be further enhanced by the cinching potential of a serrated grip ring 7 which may be situated within an extension aperture 6.

c) And wherein the channeled levering frame 1 may be provided with a retention aperture 14 which may receive a variety of elastic connectors of various inherent strengths and sizes as may be applicable, such as a elastic connector of a lesser diameter 42, a elastic connector of the larger diameter 44, each of which may respectively be of the common o-ring variety, and/or an adjustable elastic connector 46 comprised of integrated restraining stops 47, to note just a few representative examples of elastic connectors which are each independently able to receive, retain, secure, and/or connect a bottle of various neck dimensions and shapes to the channeled levering frame 1, and when utilized in unison with a support/levering protuberance 8 being itself situated below a circumferential flange 54 situated on the neck 53 of a bottle 53 as aforementioned relative to FIG. 6, and as hereinafter described, serves to keep a bottle 53 firmly in place and duly retained and supported by the channeled levering frame 1 throughout the course of its deployment, while preserving the ability for the channeled levering frame 1 to be pivoted to variable positions, thereby allowing the user lip access to the top of a bottle 53 in a manner as hereinafter described.

d) The channeled levering frame 1 may be further provided with an aperture 12 to receive a connector 32 of a supplemental adaptor 30 wherein said supplemental adaptor 30 may be provided with retention/clamping prongs 36L, 36R, which system may be customized to fit the necks of a bottles 53 of various sizes and shapes as the end-use application may require, and/or the supplemental adaptor 30 may be provided with an ancillary aperture 38 into which a elastic connector 42,44,46 may be inserted to either supplement, and/or to otherwise independently act to retain, support, and to affix a bottle 53 to a channeled levering frame 1.

e) A connector 32 of a supplemental adaptor 30 may be provided with a retaining notch 34 which, upon the supplemental adaptor 30 being fitted into the receiving aperture 12 of the channeled levering frame 1, may thereby be retained by an ancillary key 28 which may be retained in the channeled levering frame 1 with an associated thumbscrew 26, each of which are respectively fitted into the transverse keyhole aperture 26 from opposite sides of said channeled levering frame 1, thereby providing the channeled levering frame 1 with the ability to pivot about the axis of said connector 32 of said supplemental adaptor 30, with the amount said channeled levering frame 1 is allowed to pivot on said connector 32 of said supplemental adaptor 30 being restricted by the interaction of and between an integrated stop 40R, 40L, integral to said supplemental adaptor 30, and the top of a support/levering protuberance 8.

f) Further depicted is an ancillary closure stop 20 which may be fitted into an ancillary transverse aperture 16 of the channeled levering frame 1, whose regulating tip, being situated between the limiting stops 18A, 18B, protruding from the body of said channeled levering frame 1, may be utilized to optionally block the divergent channel 4 to disallow an accoutrement, or an extraneous item, from passing back through the divergent channel 4 subsequent to the item having been previously channeled into the extension aperture 6 via the divergent channel 4.

g) Additionally, an ancillary jacking lip 22R,22L and/or an ancillary jacking protuberance 24, either integral and/or fastened to the channeled levering frame 1, may serve as a means whereby the channeled levering frame 1 may be utilized to lever a bottle cap 60 of the press-on variety from off of the top of a bottle 53 in a manner as previously described.

h) And depicting a supplemental adaptor 30 and the alternative manner in which said supplemental adaptor 30 may be paired with a variety of elastic connectors to serve as a means by which the neck of a bottle becomes affixed to the channeled levering frame 1 in a manner as hereinafter described.

Figure 11:
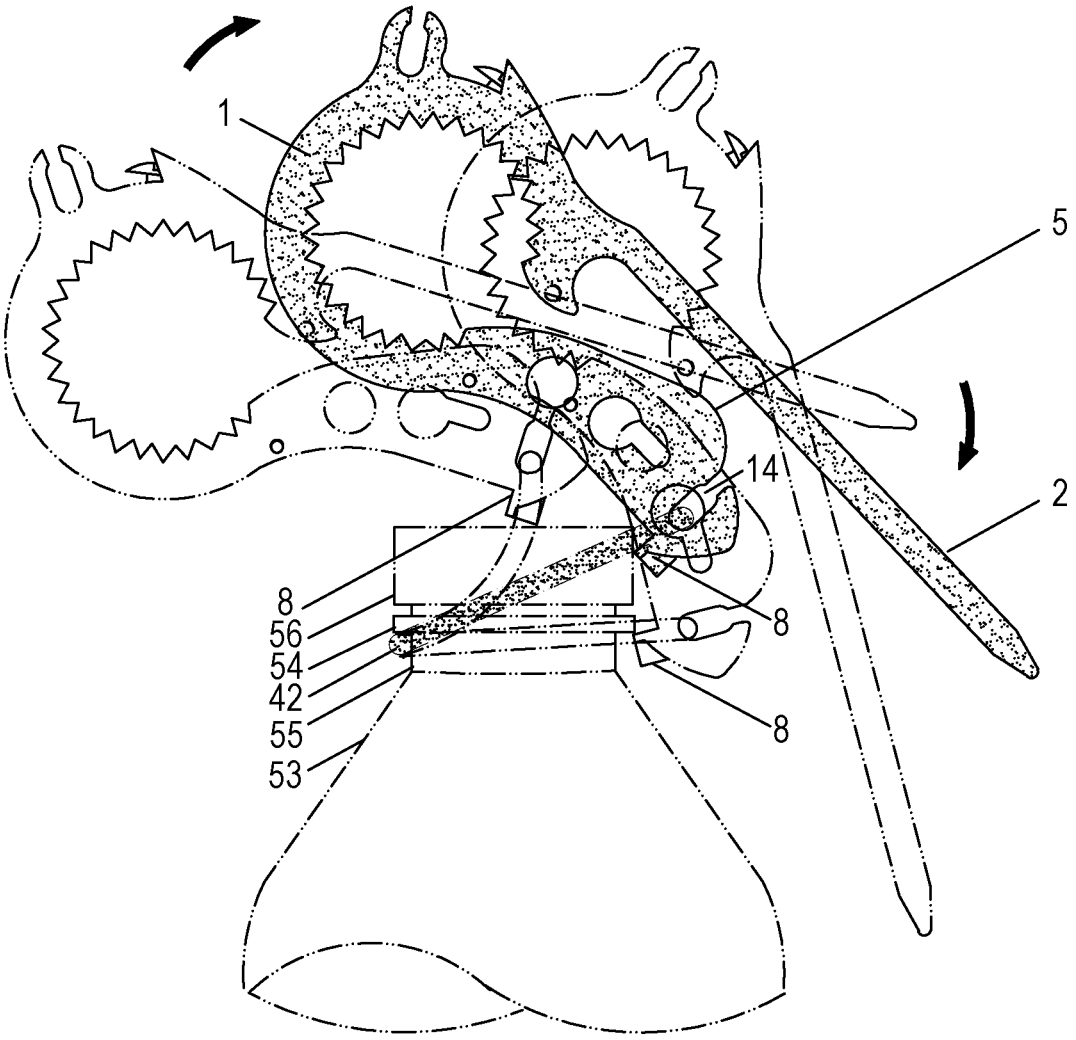
FIG. 11 A three tier sequential side view of a channeled levering frame as it would appear while in the process of levering a elastic connector, such as a common o-ring, onto the neck of a commercially manufactured bottle.

FIG. 11 A side view depicting the sequential manner in which a elastic connector 42, a portion of which has been previously anchored below the circumferential flange 54 of the neck 55 of a bottle 53, is levered onto the neck 55 of a bottle 53 by the combined levering action being imposed on said elastic connector 42 by an external force being exerted upon the channeled levering frame 1 which, in unison with the anchoring attribute afforded to the assembly by the support/levering protuberance 8 acting in resistance against the upper edge of a bottle cap 56, serves to lever the elastic connector 42 being retained in an aperture 14 of the channeled levering frame 1, onto the neck of a bottle 53, such that the support/levering protuberance 8 subsequently becomes affixed beneath the circumferential flange 54 on the neck 55 of a bottle 53.

Figure 12:
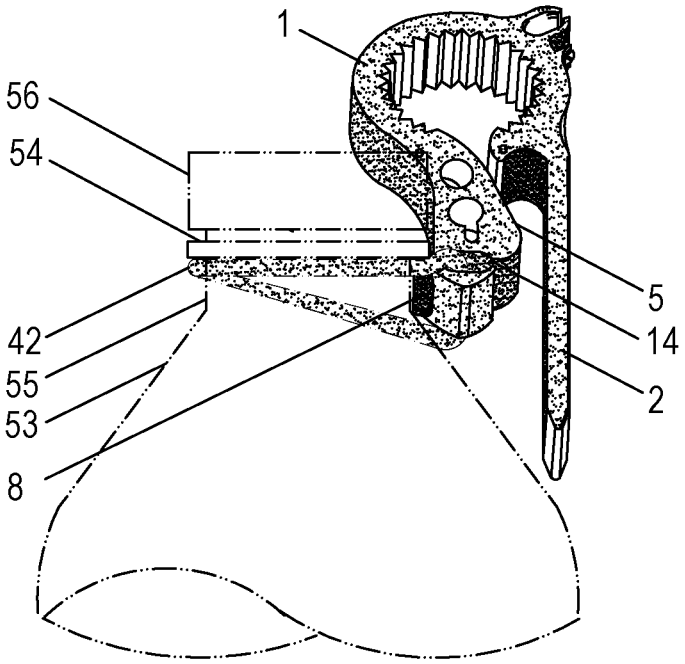
FIG. 12 A perspective side view of the present device depicting a channeled levering frame while in the midst of being pivoted upon the axis of a support/levering protuberance, which is being held more firmly beneath the circumferential flange of a commercially manufactured bottle by the increased tensile force being imposed upon the entire assembly by an elastic connector, such as a common o-ring, which is now in torsion, thereby allowing the user lip access to the contents of a bottle.

FIG. 12 A perspective side view of the present device relative to FIG. 11 depicting an elastic connector 42 in torsion as the assembled device of this particular configuration might appear when a channeled levering frame 1 is in the process of being pivoted away from the cap 56 of a bottle 53 about the axis of a support/levering protuberance 8 which is becoming more firmly held beneath a circumferential flange 54 on the neck 55 of a bottle 53 by the increased pressure being inwardly exerted on the assembly by the torsion of the elastic connector 42 acting upon, and through, a channeled levering frame 1 which by transference of force, is being more firmly held against the neck 55 of a bottle 53, thereby allowing the user lip access to the cap 56 of a bottle 53 and therefore to the contents of said bottle 53.

Figure 13:
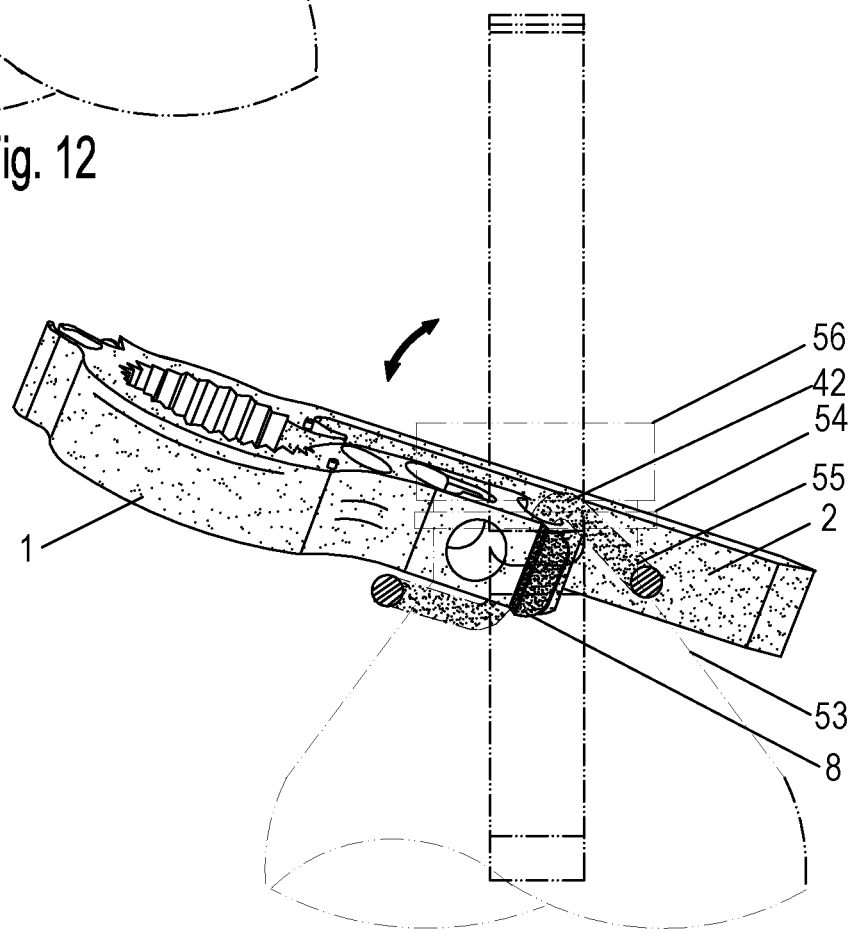
FIG. 13 A perspective frontal view of the present device, relative to FIG. 12, depicting a partial cut-away view of an elastic connector as it would appear while in torsion on a transparent bottle.

FIG. 13 A perspective frontal view of the present device relative to FIG. 11, and FIG. 12, depicting a partial cut-away view highlighting an elastic connector 42 as said elastic connector 42 may appear when a channeled levering frame 1 is in the process of being pivoted away from the cap 56 of a bottle 53 about the axis of a support/levering protuberance 8 which is being more firmly held beneath a circumferential flange 54 on the neck 55 of a bottle 53 by the increased pressure being exerted on the assembly by the torsion of the elastic connector 42 acting upon, and through, a channeled levering frame 1 which by transference of force, is being more firmly held against the neck 55 of a bottle 53, thereby allowing the user lip access to the cap 56 of a bottle 53 and therefore to the contents of said bottle 53.

Figure 14:
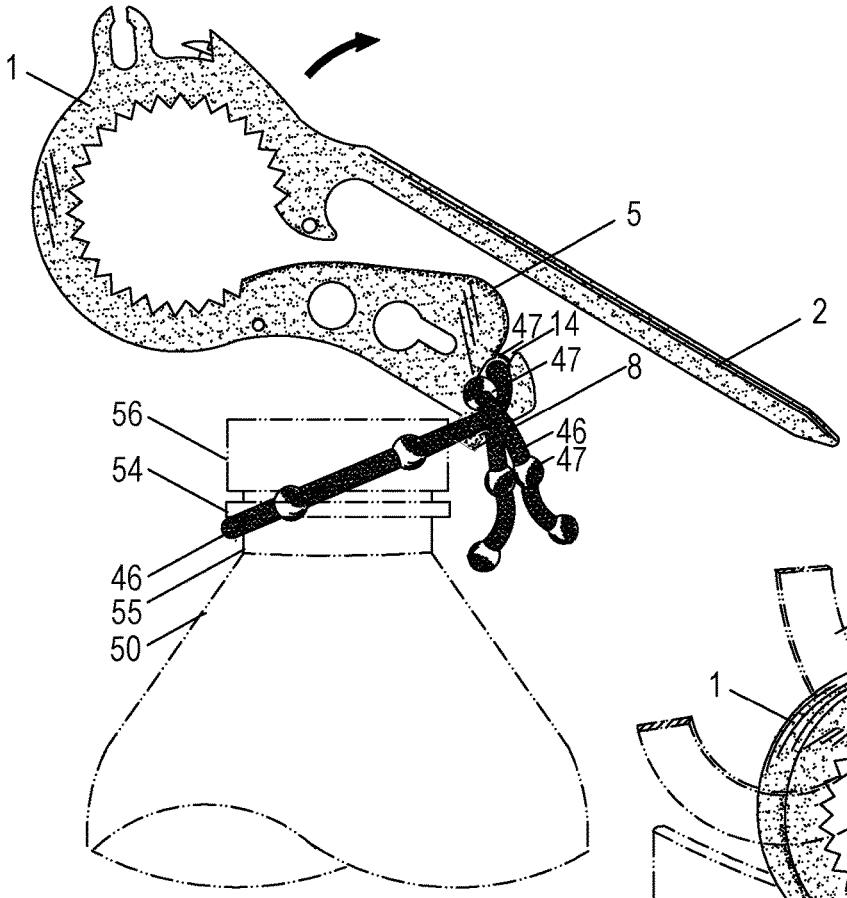
FIG. 14 A side view of a channeled levering frame depicting the manner in which the support/levering protuberance, anchored against the top outer lip of a bottle cap, serves as an aid in levering an adjustable elastic connector with integrated stops onto the neck of a commercially manufactured bottle.

FIG. 14 A side view depicting an adjustable elastic connector 46, a portion of which has been previously anchored below the circumferential flange 54 of the neck 55 of a bottle 50, as said adjustable elastic connector 46 comprised of integrated restraining stops 47 may appear when said adjustable elastic connector 46 is at a midpoint of being levered onto or off of the neck 55 of a bottle 50 via the levering force being externally imposed on said channeled levering frame 1 and the support/levering protuberance 8 which is acting, at this stage of the levering process, with an equal force against the upper edge of a bottle cap 56 to which said support/levering protuberance 8 has been temporarily anchored, to collectively serve as the means by which the adjustable elastic connector 46, which is being duly restrained in aperture 14 by the restrictive force of the integrated stops 47 acting against, and to either side of the channeled levering frame 1, may be levered onto or off of the neck of the bottle 50, such that the support/levering protuberance 8 is thereafter guided toward, or away from, its toting service position beneath the circumferential flange 54 on the neck 55 of a bottle 50.

Figure 15:
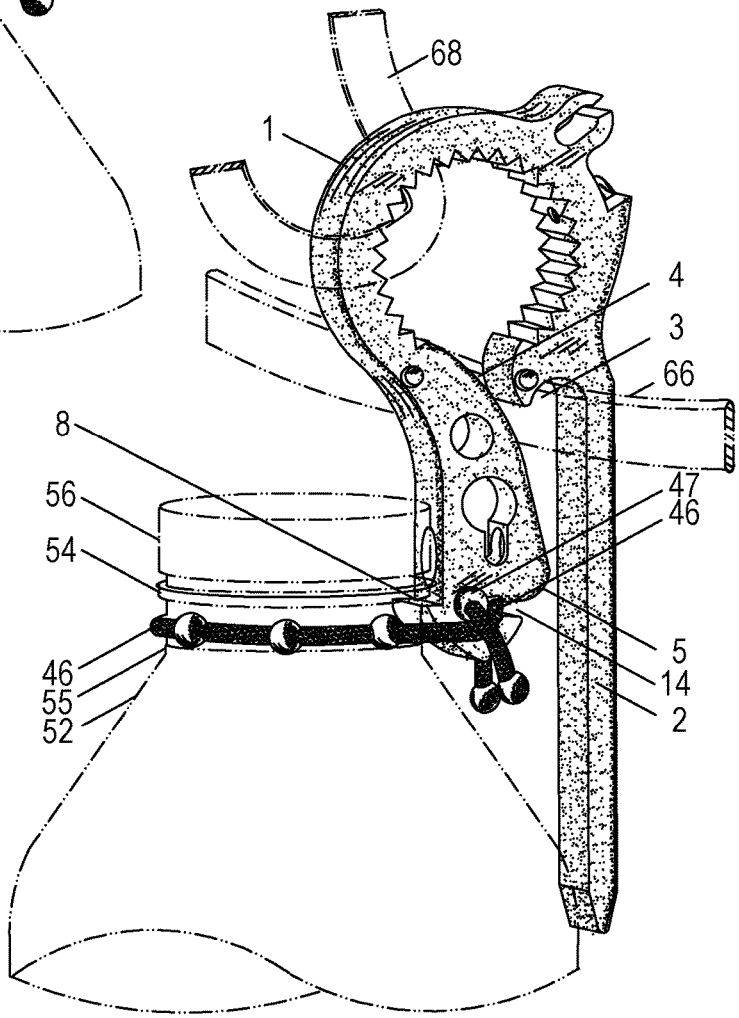
FIG. 15 A perspective view of the present device depicting a channeled levering frame in vertical alignment as it may appear while retaining and supporting a commercially manufactured bottle utilizing an adjustable elastic connector comprised of integrated restraining stops, which has been previously levered onto the neck of a bottle, and the manner in which the assembled device may be subsequently attached to various accoutrements, such as being suspended on a belt worn about the waist, or suspended from the strap of a pocketbook for instance.

FIG. 15 A perspective side view of the assembled device relative to FIG. 14 depicting a channeled levering frame 1 as said channeled levering frame 1 may appear in one possible configuration when vertically aligned on an upright bottle of the wide necked variety 52 with an adjustable elastic connector 46, and the support/levering protuberance 8, respectively affixed to and situated below the circumferential flange 54 on the neck 55 of a bottle 52, with the integrated restraining stop 47 of said adjustable elastic connector 46 acting in opposition to either side of said the exterior sidewalls of said channeled levering frame 1 serving to retain said adjustable elastic connector 46 in the retention aperture 14 of said levering frame 1, and further depicting the respective manner in which the channeled levering frame 1, utilizing the self-aligning blind terminus channel 3, and/or the divergent channel 4, may be suspended upon, and/or may be suspended from, various forms of exampled accoutrements such as a belt worn about the waist 66, or the strap of a pocketbook 68 for instance.

Figure 16:
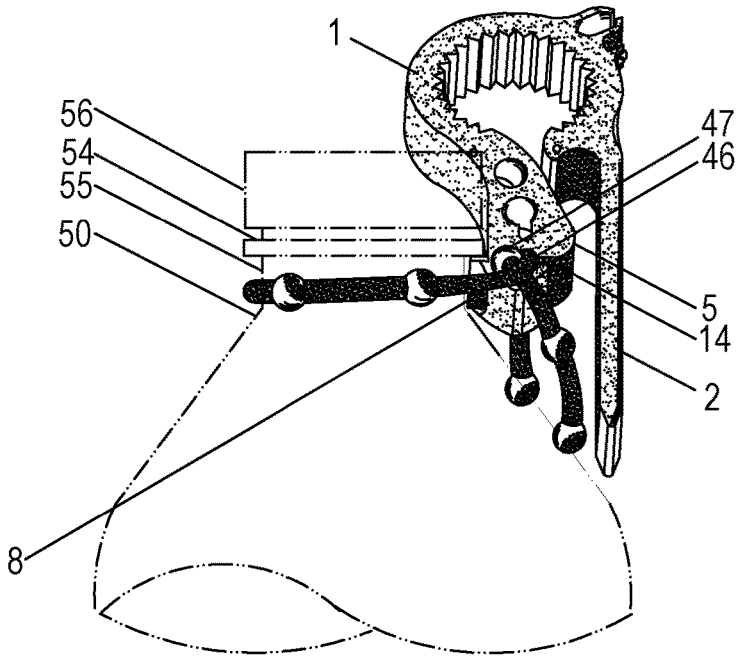
FIG. 16 A perspective side view of the present device depicting a channeled levering frame while in the midst of being pivoted upon the axis of a support/levering protuberance, which is being held more firmly beneath the circumferential flange of a commercially manufactured bottle by the increased tensile force being imposed upon the entire assembly by an adjustable elastic connector comprised of integrated restraining stops, which is now in torsion, thereby allowing the user lip access to the contents of a bottle.

FIG. 16 A perspective side view of the present device relative to FIG. 15 depicting an adjustable elastic connector 46 in torsion as the assembled device of this particular configuration might appear when a channeled levering frame 1 is in the process of being pivoted away from the cap 56 of a bottle 50 about the axis of a support/levering protuberance 8 which is becoming more firmly held beneath a circumferential flange 54 on the neck 55 of a bottle 50 by the increased pressure being inwardly exerted on the assembly by the torsion of the adjustable elastic connector 46 acting upon, and through, a channeled levering frame 1 which by transference of force, is being more firmly held against the neck 55 of a bottle 50, thereby allowing the user lip access to the cap 56 of a bottle 50, and therefore to the contents of said bottle 50.

Figure 17:
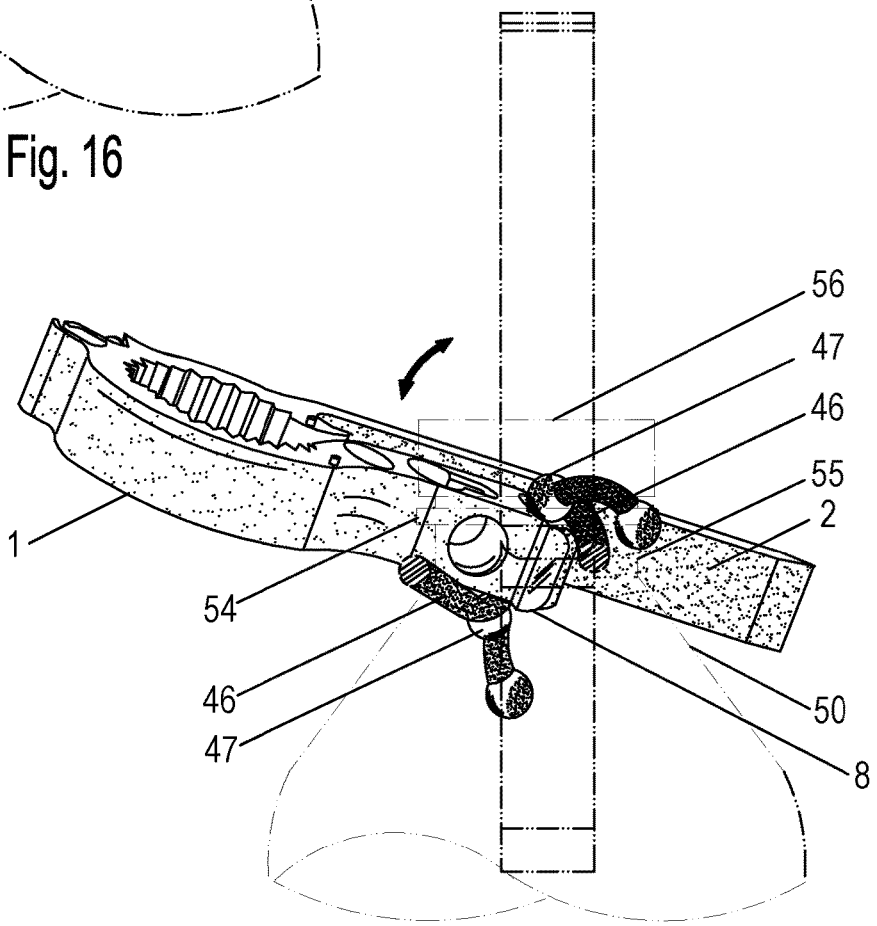
FIG. 17 A perspective frontal view of the present device, relative to FIG. 16, depicting a partial cut-away view of an adjustable elastic connector comprised of integrated restraining stops while in torsion when a channeled levering frame is being pivoted upon a support/levering protuberance which is being held fast beneath the circumferential flange of a commercially manufactured bottle by the increased tensile force being imposed upon the entire assembly by the elastic connector, thereby allowing the user lip access to the contents of a bottle.

FIG. 17 A frontal perspective view of the present device relative to FIG. 16, depicting a partial cut-away view to highlight an adjustable elastic connector 46 with integrated restraining stops 47 as they may respectively appear, wherein said integrated restraining stops 47, being duly restrained to either side of a channeled levering frame 1, and in opposition to one another, serve to retain said adjustable elastic connector 46 in the retention aperture 14 of said channeled levering frame 1, of this particular configuration, as an external force is being applied to said channeled levering frame 1 while in the process of being pivoted away from the cap 56 of a bottle of the narrow neck variety 50 as said channeled levering frame 1 rotates about the axis of a support/levering protuberance 8 which is being more firmly held beneath a circumferential flange 54 on the neck 55 of a bottle 50 by the increased inwardly acting pressure being exerted on the assembly by the torsion of said adjustable elastic connector 46 acting upon and through a channeled levering frame 1 which by transference of force, is being more firmly held against the neck 55 of a bottle 50, thereby allowing the user lip access to the cap 56 of a bottle 50, and therefore to the contents of said bottle 50.

Figure 18:
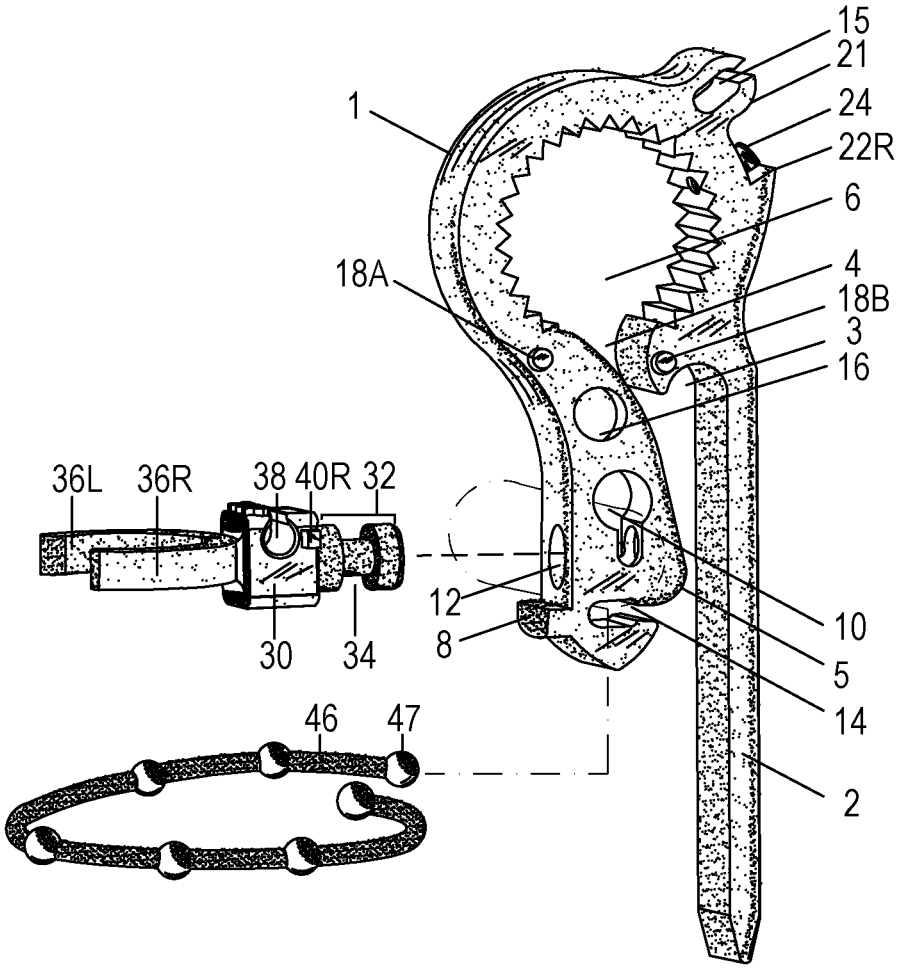
FIG. 18 An exploded perspective view depicting one possible configuration of the present device depicting the manner in which a supplemental adaptor, and an adjustable elastic connector comprised of integrated restraining stops, may be fitted, and subsequently secured to a channeled levering frame by the interaction of and between the cited components.

FIG. 18 An exploded perspective side view depicting one possible configuration of the present device when in vertical alignment and the manner in which the connector 32 of a supplemental adaptor 30 may be inserted into the receiving aperture 12 of a channeled levering frame 1 wherein said connector 32 of said supplemental adaptor 30 may be thereby retained in said channeled levering frame 1 by the subsequent tensioning of a portion of an adjustable elastic connector 46 which, subsequent to one end of said adjustable elastic connector 46 being inserted into a retention aperture 14, whereby said adjustable elastic connector 46 is thereafter retained by an integrated restraining stop 47 acting against the sidewall of the channeled levering frame 1, after which said adjustable elastic connector 46 is then duly routed around and about said channeled levering frame 1 such that, subsequent to said adjustable elastic connector 46 being passed through keyhole aperture 10 and wound back and around said channeled levering frame 1, said adjustable elastic connector 46 is then inserted, once again, into the restraining aperture 14 such that an opposing integrated restraining stop 47 acts in opposition to the first integrated restraining stop 47 whereby the inherent restraining aspects of the duly tensioned narrowed portion of an adjustable elastic connector 46, becoming firmly seated in the notch 34 of said connector 32 of said supplemental adaptor 30 which was previously inserted into said receiving aperture 12 of said channeled levering frame 1, causes the adaptor connector 32 to become firmly retained in said receiving aperture 12 in said channeled levering frame 1 by the tensioned narrow portion of said adjustable elastic connector 46 while further allowing the channeled levering frame 1 to pivot about the axis of said connector 32 of said supplemental adaptor 30.

Figure 19:
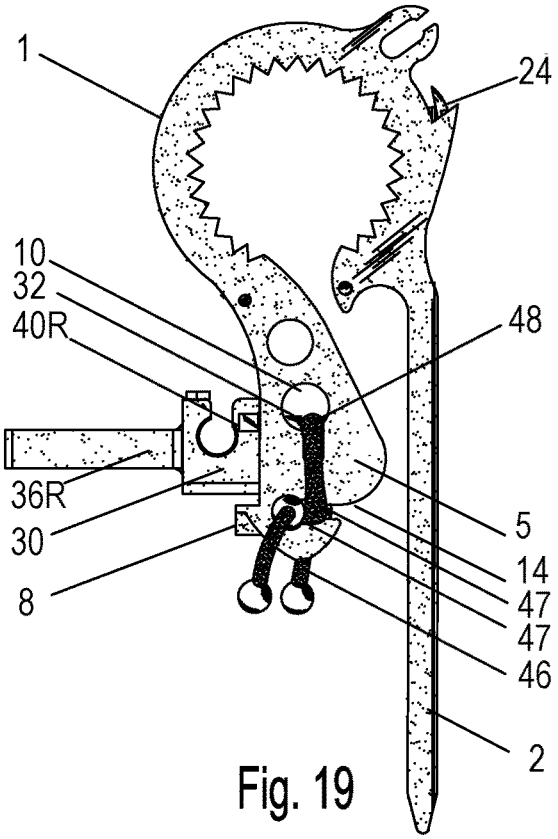
FIG. 19 A side view of the present device, relative to FIG. 18, as it may appear when assembled.

FIG. 19 A side view of the present device relative to FIG. 18 as it would appear when assembled in this particular configuration. More specifically the manner in which a restraining stop 47 of a tensioned adjustable elastic connector 46 would appear subsequent to said adjustable elastic connector 46, having been initially inserted into the retention aperture 14, and thereafter routed around and about the channeled levering frame 1, and being passed back through the keyhole aperture 10, and inserted once again into the retention aperture 14 of the channeled levering frame 1, such that the respective opposing integrated restraining stops 47, acting against the opposing exterior sidewalls of said channeled levering frame 1, serve to retain and secure said adjustable elastic connector 46 in said retention aperture 14 and said keyhole aperture 10, to thereby retain said supplemental adaptor 30 in said channeled levering frame 1 without diminishing the ability of said channeled levering frame 1 to pivot about the axis of the aforesaid, and hereinafter described, connector 34 of a supplemental adaptor 30.

Figure 20:
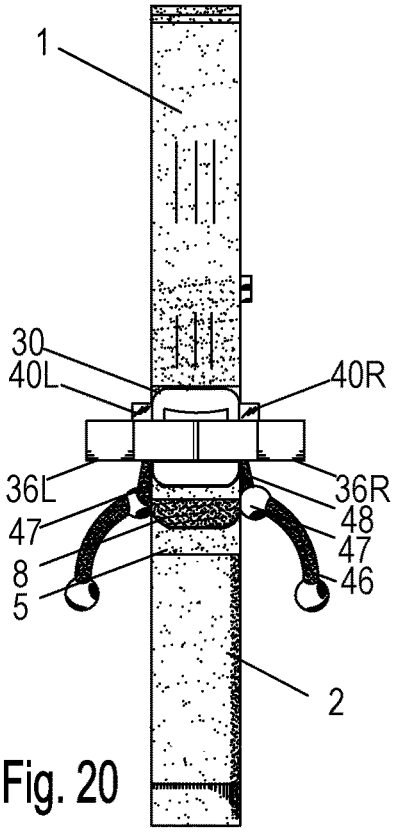
FIG. 20 A front view of the present device relative to FIG. 18 and FIG. 19.

FIG. 20 A front view of the present device relative to FIG. 18 and FIG. 19.

Figure 21:
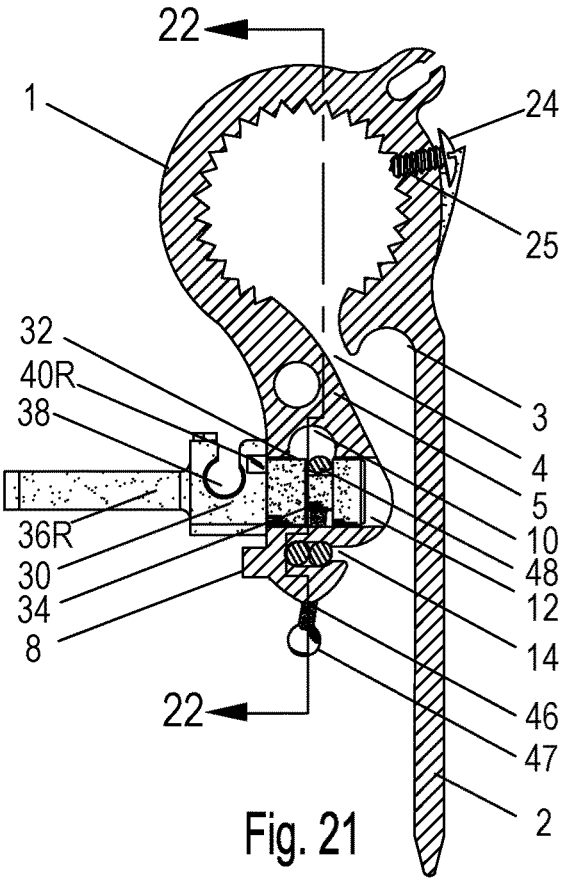
FIG. 21 A cross-sectional side view of the channeled levering frame of the present device relative to FIG. 19 highlighting the internal manner in which a supplemental adaptor may be retained in a channeled levering frame, in this particular configuration, by the interaction of and between the tensioned narrow portion of an adjustable elastic connector comprised of integrated restraining stops, which has been routed and threaded through a series of applicable retention apertures, and the notch of a supplemental adaptor connector into which the narrow portion of the tensioned adjustable connector, having elastic properties, has become firmly seated, and which thereby serves to retain the supplemental adaptor in the channeled levering frame while preserving the ability for the channeled levering frame to pivot about the axis of the supplemental adaptor connector.

FIG. 21 A sectional side view of the present device relative to FIG. 19 depicting the internal manner in which the tensioned narrow portion 48 of an adjustable elastic connector 46 comprised of integrated restraining stops 47, interacts with a retaining notch 34 of a connector 32 of a supplemental adaptor 30, to serve as a means for retaining said connector 32 of said supplemental adaptor 30 in a receiving aperture 12 of a channeled levering frame 1.

Figure 22:
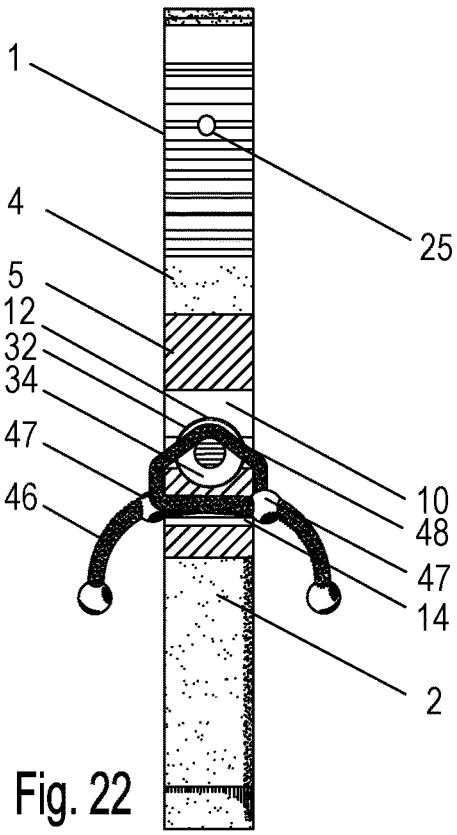
FIG. 22 A front cross-sectional view of a channeled levering frame of the present device relative to FIG. 21.

FIG. 22 A select cross-sectional front view of the present device relative to FIG. 19, FIG. 20, and FIG. 21 depicting the internal manner in which the tensioned narrow portion 48 of an adjustable elastic connector 46, which is being retained in the retention aperture 14 of the channeled levering frame 1 by the integrated restraining stops 47 acting in opposition to one another against the exterior sidewalls of said channeled levering frame 1, interacts with the retaining notch 34 of a connector 32 of a supplemental adaptor 30 to thereby retain said supplemental adaptor 30 in a receiving aperture 12 of a channeled levering frame 1 while preserving the ability for the channeled levering frame 1 to pivot about the central axis of a connector 32 of a supplemental adaptor 30 when the present device is assembled relative to this particular configuration.

Figure 23:
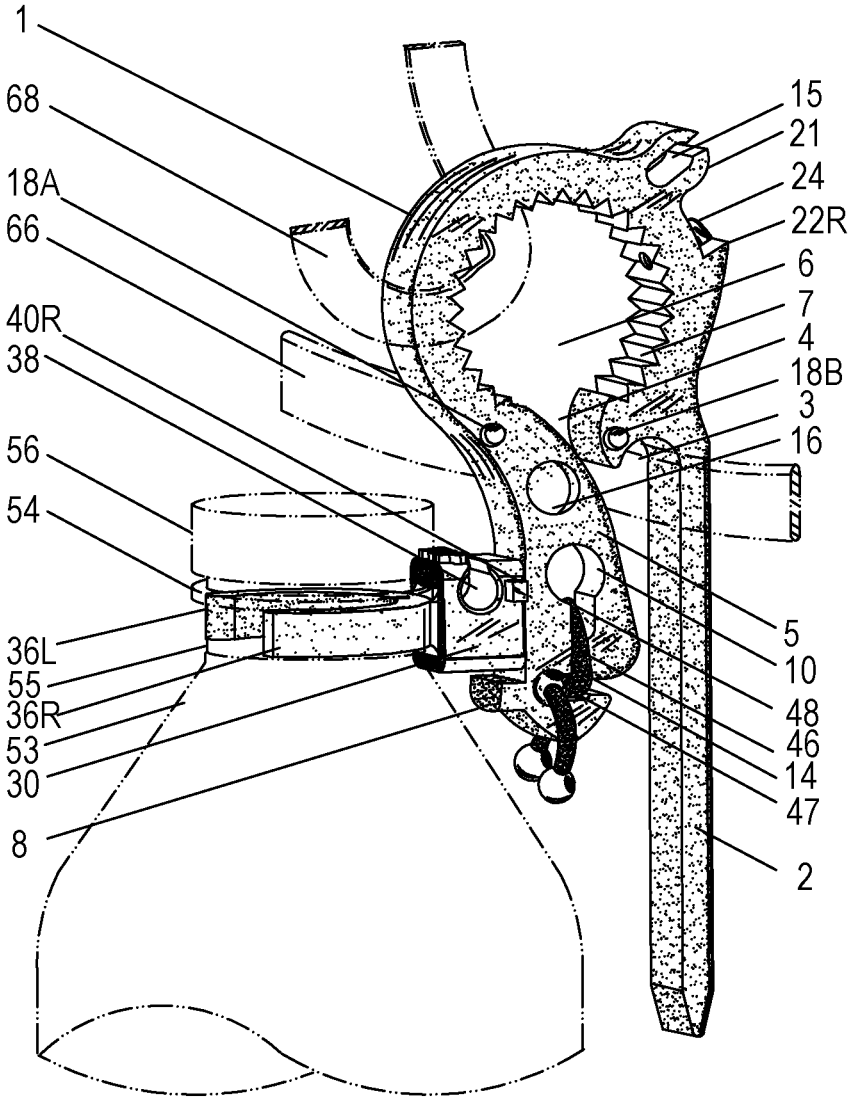
FIG. 23 A perspective view of the present device, relative to FIG. 18, FIG. 19, FIG. 20, FIG. 21 and FIG. 22 depicting a channeled levering frame in typical vertical alignment as the assembled device, of this particular configuration, would appear while retaining and supporting a commercially manufactured bottle while attached to various accoutrements, such as being suspended on a belt worn about the waist, or suspended from a pocketbook strap for instance.

FIG. 23 A perspective view depicting the present device relative to FIG. 18, FIG. 19 and FIG. 20, as the assembled device may appear in this configuration with a vertically aligned channeled levering frame 1 affixed to the neck 55 of a bottle 53 via the clamping action of the left 36L and right 36R retention/clamping prong of a supplemental adaptor 30 which is being retained in said channeled levering frame 1 by the aforesaid interaction of and between the tensioned narrow portion 48 of a duly restrained adjustable elastic connector 46 acting in unison with the retaining notch 34 of a supplemental adaptor 30 connector 32 being retained in the receiving aperture 12 of a channeled levering frame 1 whereby said channeled levering frame 1, by utilizing the self-aligning blind terminus channel 3, and/or the divergent channel 4, is depicted as having been subsequently slid onto, suspended upon, or otherwise suspended from, various forms of exampled accoutrements such as a belt worn about the waist 66, or the strap of a pocketbook 68 for instance.

Figure 24:
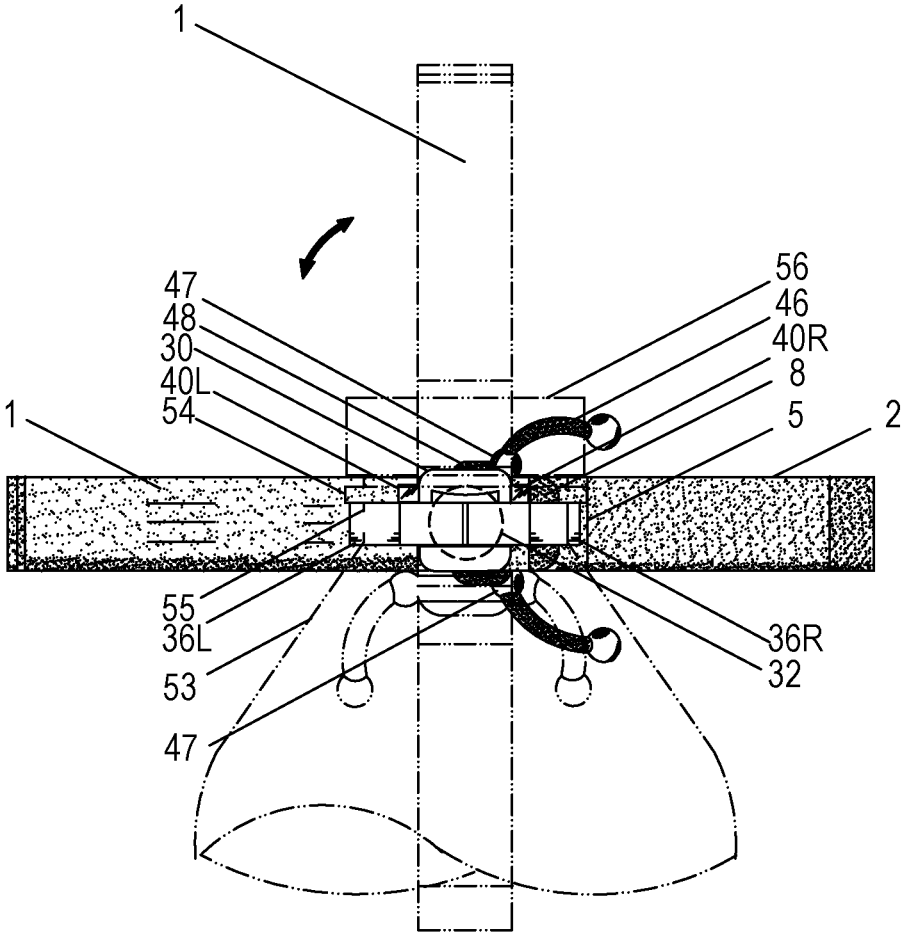
FIG. 24 A frontal view of the present device relative to FIG. 23 depicting a channeled levering frame as it may appear subsequent to being pivoted from a vertical alignment to a full horizontal position about the axis of a supplemental adaptor connector, thereby allowing the user lip access to the contents of a of a commercially manufactured bottle.

FIG. 24 A front view of the present device relative to FIG. 20, FIG. 22, and FIG. 23 depicting a channeled levering frame 1 as it may appear with the prongs 36L, 36R of a duly retained supplemental adaptor 30 when affixed to the neck 55 of a bottle 53 subsequent to said channeled levering frame 1 having been pivoted to a horizontal/perpendicular position relative to the top to bottom axis of a bottle 53, and to further highlight the manner in which an integrated stop 40R, integral to the sidewall of a supplemental adaptor 30, may interact with a support/levering protuberance 8 to limit the amount said channeled levering frame 1 is allowed to pivot on the axis of a connector 32 of a supplemental adaptor 30, to thereby allow the user access to the cap 56 of a bottle 50, and therefore to the contents of said bottle 53.

FIG. 25 A side view of the present assembled device as it may appear in one particular configuration when, in lieu of utilizing an aforementioned adjustable elastic connector 46 as a means by which a connector 32 of a supplemental adaptor 30 is retained in the channeled levering frame 1, a thumbscrew 26, and an associated ancillary key 28, relative to FIG. 10, are respectively inserted into the transverse keyhole aperture 10 from opposite sides of the channeled levering frame 1 to interact, as an assembly, with the retaining notch 34 of an aforementioned connector 32 of a supplemental adaptor 30, to thereby serve as an alternative means by which a supplemental adaptor 30 is retained within the receiving aperture 12 of said channeled levering frame 1 which subsequently allows said channeled levering frame 1 to pivot upon the axis of a connector 32 of a supplemental adaptor 30.

Also depicted, situated between the limiting stops 18A, 18B, which are integral to a channeled levering frame 1, is a pivoting auxiliary closure stop 20 which, being inserted and retained in ancillary aperture 16 relative to FIG. 10, may be utilized to disallow an accoutrement, such as a strap of a pocketbook 68, or an extraneous item such as the fixed clip 69 on a refillable water bottle, from passing back through the divergent channel 4 subsequent to the accoutrement, or the extraneous item, having been previously guided into the extension aperture 6.

FIG. 26 A front view of the present assembled device of this particular configuration relative to FIG. 25.

FIG. 27 A select cross-sectional front view of a channeled levering frame 1 relative to FIG. 25 and FIG. 26 depicting the internal manner in which an ancillary key 28, fitted into a transverse keyhole aperture 10, and thereby duly restrained by a thumbscrew 26 fitted into the ancillary key 28 from the opposite side of said channeled levering frame 1, interacts with a notch 34 of a connector 32 of a supplemental adaptor 30, which thereby causes said connector 32 of said supplemental adaptor 30 to be duly retained in a receiving aperture 12 of said channeled levering frame 1, and further depicting the manner in which a pivoting closure stop 20 may be fitted into an ancillary aperture 16 of said channeled levering frame 1.

FIG. 28 A front view of the present device relative to FIG. 25, FIG. 26, and FIG. 27 depicting a channeled levering frame 1 as said channeled levering frame 1 would subsequently appear when pivoted to a horizontal/perpendicular position when affixed to the neck 55 of a vertically aligned bottle 53 via the clamping action provided to the device by the prongs 36R, 36L of a supplemental adaptor 30, and further highlighting the manner in which an integrated stop 40R of a supplemental adaptor 30 may interact with a support/levering protuberance 8 to limit the amount said channeled levering frame 1 is allowed to pivot on the axis of a connector 32 of said supplemental adaptor 30, thereby allowing the user access to the bottle cap 56, and therefore to the contents of a bottle 53.

FIG. 29 A select cross-sectional front view of the present device relative to FIG. 27 and FIG. 28 depicting the internal manner, in this particular configuration, in which an ancillary key 28, fitted into a transverse keyhole aperture 10, and thereby duly restrained by a thumbscrew 26 from the opposite side of said channeled levering frame 1, interacts with a notch 34 of a connector 32 of a supplemental adaptor 30, to thereby retain said connector 32 of said supplemental adaptor 30 in a receiving aperture 12 of said channeled levering frame 1 subsequent to said channeled levering frame 1 having been pivoted to a horizontal/perpendicular position about the axis of said connector 32 of said supplemental adaptor 30.

FIG. 30 A perspective view depicting one particular configuration of the present device comprised of a supplemental adaptor 30 connected to a channeled levering frame 1 via an elastic connector 44,46 which may be inserted into both the retention aperture 14 of a channeled levering frame 1, and into the ancillary aperture 38 of a supplemental adaptor 30, such that said supplemental adaptor 30, when initially affixed to a neck of a bottle, thereby serves as an anchoring means to aid in the process of stretching said elastic connector 44,46 onto the neck of a bottle in a manner as hereinafter described.

FIG. 31 A side view of the present device relative to FIG. 30 depicting the manner in which the representative retention/clamping prong 36R and its companion prong 36L of a supplemental adaptor 30, having been previously pressed and thereby clamped onto the neck 55 of a bottle 53 beneath a circumferential flange 54 of said bottle 53 thereby serves as an anchoring means by which an elastic connector 44 may be rendered less unwieldy while being subsequently stretched over the cap 56 of a bottle 53 via the combined levering action and gripping characteristic of a support/levering protuberance 8 acting in unison with an externally applied levering force being exerted by the user on a channeled levering frame 1 by way of the elongated levering arm 2, thereby providing an alternative means by which said elastic connector 44 may be levered onto, or off of, the neck 55 of a bottle 53.

FIG. 32 A perspective view of the present device relative to FIG. 30 and FIG. 31 depicting the assembled device, of this particular configuration, as it may appear in a typical toting position, mounted to a bottle 53 while suspended from, or suspended upon, various accoutrements such as a belt 66 worn about the waist, or a pocketbook strap 68 for instance.

FIG. 33 A perspective side view of the present device relative to FIG. 32 depicting an elastic connector 44 in torsion as the assembled device, of this particular configuration, might appear when a channeled levering frame 1 is in the process of being pivoted away from the cap 56 of a bottle 53 as said channeled levering frame 1 rotates about the axis of the support/levering protuberance 8 which becomes more firmly held beneath a circumferential flange 54 on the neck 55 of a bottle 53 by the increasing pressure being inwardly exerted on the assembly by the torsion of said elastic connector 44 acting upon and through a channeled levering frame 1 which by transference of force, is being more firmly held against the neck 55 of a bottle 53, thereby allowing the user lip access to the cap 56 of a bottle 53, and therefore to the contents of said bottle 53.

FIG. 34 A frontal perspective view of the present device relative to FIG. 32, and FIG. 33, depicting a select partial cut-away view highlighting an elastic connector 44 as said elastic connector 44 would appear when a channeled levering frame 1 is in the process of being pivoted away from the cap 56 of a bottle 53 about the axis of a support/levering protuberance 8 which is being more firmly held beneath a circumferential flange 54 on the neck 55 of a bottle 53 by the increased inwardly acting pressure being exerted on the assembly by the torsion of the elastic connector 44 acting upon and through a channeled levering frame 1 which by transference of force, is being more firmly held against the neck 55 of a bottle 53, thereby allowing the user lip access to the cap 56 of a bottle 53, and therefore to the contents of said bottle 53.

FIG. 35 A sequential side view of the assembled device relative to FIG. 31, FIG. 32, FIG. 33, and FIG. 34 depicting the manner in which an extremity of a channeled levering frame 1 may be subsequently utilized to disengage a supplemental adaptor 30 from a neck 55 of a bottle 53 by inserting the extremity of an elongated levering arm 2 between the raised edge 37 of a supplemental adaptor 30, and a bottle cap 56, for the purpose of levering a firmly affixed supplemental adaptor 30 from off of the neck 55 of a bottle 53.

FIG. 36 A side view of a channeled levering frame 1 depicting the manner in which a selected elastic connector of the continuous type 70, such as a common o-ring, or an elastic connector of the open-ended type, such as an adjustable elastic connector 46 with integrated restraining stops 47, or a common strap-type of cable tie 72, or a common beaded-type of cable tie 76, or a lacing 74, or the like, each of which may be respectively utilized to retain and/or to support a commercially manufactured bottle 53 about the neck 55 such that said bottle 53 may become affixed to said channeled levering frame 1 in a similar manner as heretofore described, and where said open-ended connectors 46, 72,74 may also be utilized, in combination with an ancillary transverse aperture 16, and/or with a retention aperture 15, as an alternative means by which the divergent channel 4 may be closed off for the purpose of disallowing any extraneous item, such as a clip 69 on a refillable beverage container 78 as an example, which had been previously guided into, or otherwise attached to an extension aperture 6 grip ring 7, from exiting the channeled levering frame 1 via the divergent channel 4.

CONCLUSIONS, RAMIFICATIONS AND SCOPE

The reader will see that I have provided an improved means for the transportation of a personal water or beverage bottle that:

a. is universal in nature.
b. promotes recycling of plastic bottles.
c. is practical.
d. is customizable.
e. is durable.
f. is stable.
g. is less awkward to use.
h. is of compact design.
i. is easily toted hands-free.
j. is easy to make.
k. is easy to assemble and disassemble in the field.
l. is easily prepared.
m. is easy to handle.
n. is easy to store.
o. is easily accessed.
p. is easily and swiftly adjusted as the dynamic conditions, as well as the environs of the user change throughout the term of its use.
q. is gravitationally sensitive as the dynamic conditions of the user change throughout the term of its use.
r. is versatile since the components can be reconfigured to accept an array of various bottle neck shapes and sizes.
s. is easily embodied with features which allow the user to take advantage of other added conveniences such as 1) the removal of bottle caps and can lids, or 2) attaching the device to, or otherwise 3) attaching to the device, various accoutrements such as belts, pocketbook straps, hats, scarves, or other extraneous items such as refillable water or beverage bottles, tools, pet dishes, leashes, ditty bags or the like, as the user may from time to time desire to do.

I claim:

1. A flexure frame comprising a blind terminus channel, an elongated arm; and a clenching arm; wherein said blind terminus channel is situated between the elongated arm and the clenching arm, and wherein said clenching arm includes a supplemental adaptor, wherein the supplemental adaptor is selectively connected to the clenching arm of said flexure frame and wherein said supplemental adaptor further includes prongs configured for affixing a beverage container having a circumferential flange about its neck to the flexure frame.

2. A flexure frame comprising a blind terminus channel, an elongated arm; and a clenching arm; wherein said blind terminus channel is situated between the elongated arm and the clenching arm, and wherein said clenching arm includes;

a means to affix a sinuous connector, wherein said sinuous connector is configured to retain a beverage container having a circumferential flange about its neck against the flexure frame; and a protuberance;

wherein the means to affix a sinuous connector and the protuberance are configured so that when said sinuous connector is disposed within the means to affix a sinuous connector to said clenching arm of said flexure frame that said sinuous connector is configured to wrap around the neck of a beverage container whereby the underside of said circumferential flange of said beverage container comes to rest on the top surface of said protuberance of said clenching arm whereby said beverage container is thereby retained and duly supported on said clenching arm of said flexure frame.

3. A multi-function levering and pivoting device comprising:

a sinuous connector comprising:

a sinuous shaft including thickened sections distributed along the length of said sinuous shaft, a flexure frame comprising a blind terminus channel, an elongated arm; and a clenching arm: wherein said blind terminus channel is situated between the elongated arm and the clenching arm, and wherein said clenching arm includes;

a means to affix said sinuous connector, wherein said sinuous connector is configured to retain a beverage container having a circumferential flange about its neck against the flexure frame; and a protuberance;

wherein the means to affix said sinuous connector and the protuberance are configured so that when said sinuous connector is disposed within the means to affix said sinuous connector to said clenching arm of said flexure frame;

said thickened sections of said sinuous connector serve as integrated restraining stops that act against the sides of said clenching arm of said flexure frame to adjust the length of said sinuous connector when affixing bottle necks of various sizes to said clenching arm of said flexure frame; and that said sinuous connector is configured to wrap around the neck of the beverage container whereby the underside of said circumferential flange of said beverage container comes to rest on the top surface of said protuberance of said clenching arm whereby said beverage container is thereby retained and supported on said clenching arm of said flexure frame.

* * * * *